US007594473B2

(12) United States Patent
Kitchen et al.

(10) Patent No.: US 7,594,473 B2
(45) Date of Patent: Sep. 29, 2009

(54) WHEEL HUB RIDER CONVEYANCE

(75) Inventors: William J. Kitchen, 11536 Lake Butler Dr., Windermere, FL (US) 34786; John H. Chance, La Selva Beach, CA (US)

(73) Assignee: William J. Kitchen, Windermere, FL (US)

( * ) Notice: Subject to any disclaimer, the term of this patent is extended or adjusted under 35 U.S.C. 154(b) by 179 days.

(21) Appl. No.: 11/419,170

(22) Filed: May 18, 2006

(65) Prior Publication Data

US 2007/0010336 A1 Jan. 11, 2007

Related U.S. Application Data

(60) Provisional application No. 60/683,167, filed on May 20, 2005.

(51) Int. Cl.
*A63G 1/00* (2006.01)

(52) U.S. Cl. ..... 104/53; 104/63

(58) Field of Classification Search ..... 104/53, 104/55, 56, 57, 63

See application file for complete search history.

(56) References Cited

U.S. PATENT DOCUMENTS

| | | | |
|---|---|---|---|
| 608,262 | A | 8/1898 | Lord |
| 646,791 | A | 4/1900 | Bemenderfer |
| 759,053 | A | 5/1904 | Whittemore |
| 2,535,862 | A | 12/1950 | Pewitt |
| 3,085,516 | A | 4/1963 | Cirami |

(Continued)

FOREIGN PATENT DOCUMENTS

| | | |
|---|---|---|
| DE | 8712286 | 10/1987 |

(Continued)

OTHER PUBLICATIONS

Written Opinion of International Search Report—mailed Sep. 29, 2006 Application No. US2006/019409 Dated: May 18, 2006 Applicant: William J. Kitchen Corresponding PCT application.

(Continued)

*Primary Examiner*—S. Joseph Morano
*Assistant Examiner*—Robert J McCarry, Jr.
(74) *Attorney, Agent, or Firm*—Oppedahl Patent Law Firm LLC; Margaret Polson

(57) ABSTRACT

A rail assembly is built from three parallel cylindrical members, wherein a first rail provides support for a large wheel. The large wheel has an axle protruding from each side, wherein the outbound side has a frame attached to the axle and a seat attached to the frame. The rail side of the axle connects to a second rail acting as a pilot/guide for the travel of the large wheel. A third rail and interconnections provide structural rigidity for the rail assembly. The riders fly through a roller coaster layout sitting only in a seat, facing the passing environment head on at high speeds, thereby experiencing a free flight sensation. A people mover embodiment adds a motor to the wheel to move the wheel along a relatively flat layout. An optional flip means functions to selectively engage the axle with the rotating large wheel (nominally via a reduction gear) to flip the riders 360°. Optionally a group of large wheels can be coupled together to form a train.

25 Claims, 26 Drawing Sheets

U.S. PATENT DOCUMENTS

| | | | |
|---|---|---|---|
| 3,093,372 | A | 6/1963 | Cirami |
| 3,120,197 | A | 2/1964 | Cirami |
| 3,297,319 | A | 1/1967 | Chereau |
| 3,476,385 | A | 11/1969 | Foy |
| 3,985,081 | A | 10/1976 | Sullivan, II |
| 4,503,778 | A | 3/1985 | Wilson |
| 4,520,732 | A | 6/1985 | Schwarzkopf |
| 4,690,064 | A | 9/1987 | Owen |
| 5,203,744 | A | 4/1993 | Checketts |
| 5,267,906 | A | 12/1993 | Kitchen |
| 5,272,984 | A | 12/1993 | Bolliger et al. |
| 5,527,223 | A | 6/1996 | Kitchen |
| 5,791,254 | A | 8/1998 | Mares et al. |
| 5,931,740 | A | 8/1999 | Kitchen |
| 5,967,938 | A | 10/1999 | Benford et al. |
| 5,979,333 | A | 11/1999 | Houben et al. |
| 6,047,645 | A | 4/2000 | Cornwell et al. |
| 6,098,549 | A | 8/2000 | Mares |
| 6,158,354 | A | 12/2000 | Eiraku |
| 6,227,121 | B1 | 5/2001 | Mares |
| 6,269,749 | B1 | 8/2001 | Hogg |
| 6,269,750 | B1 | 8/2001 | Cornwell et al. |
| 6,386,115 | B2 | 5/2002 | Mares |
| 6,402,624 | B1 | 6/2002 | Larson et al. |
| 6,440,002 | B1 | 8/2002 | Jackson |
| 6,477,961 | B1 | 11/2002 | Mares |
| 6,523,479 | B1 * | 2/2003 | Schilke et al. ..... 104/57 |
| 6,565,106 | B2 | 5/2003 | Lopez |
| 6,606,953 | B2 | 8/2003 | Mares |
| 6,622,634 | B2 | 9/2003 | Cylvick |
| 6,830,258 | B2 | 12/2004 | Foley |
| 6,840,136 | B1 | 1/2005 | Jones |
| 2003/0172834 | A1 | 9/2003 | De-Gol |
| 2006/0178221 | A1 | 8/2006 | Threlkel |

FOREIGN PATENT DOCUMENTS

| | | |
|---|---|---|
| FR | 1602703 | 1/1971 |
| FR | 2098914 | 10/1972 |
| FR | 7028286 | 10/1972 |
| FR | 2599988 | 12/1987 |
| FR | 2700967 | 8/1994 |
| GB | 04830 | 12/1909 |
| JP | 5115618 | 5/1993 |
| WO | 03082421 | 10/2003 |

OTHER PUBLICATIONS

Velocity Magnetics, Inc., Dyna-Brake from Velocity Magnetic, pp. 1-2 see http://www.velocitymagnetics.com/.

International Search Report and Written Opinion of the International Searching Authority in related PCT Application No. PCT/US2007/084395 filed Dec. 11, 2007.

* cited by examiner

WHEEL HUB RIDER CONVEYANCE

CROSS REFERENCE APPLICATIONS

This application is a non-provisional application claiming the benefits of provisional application No. 60/683,167 filed May 20, 2005.

FIELD OF INVENTION

The present invention relates to a roller coaster-type amusement ride and/or people mover, wherein a large wheel travels along a track, the wheel's axle supporting a rider compartment.

BACKGROUND OF THE INVENTION

Roller coasters have long been some of the most well-liked rides in amusements parks. Roller coasters normally have an endless track loop. Riders load and unload at a platform or station, typically at a low elevation. At the beginning of each ride cycle, a roller coaster car or a train of cars is generally towed or propelled up a relatively steep incline of an initial track section to the highest point on the entire track. The car is then released from the high point and gains kinetic energy, which allows the car to travel entirely around the track, and return back to the loading/unloading station. The roller coaster track typically includes various loops, turns, inversions, corkscrews and other configurations intended to thrill the riders.

Since the early days of roller coasters, people have experimented with variations of a central theme, which is to provide amusement to riders seated inside cars which travel along tracks. Traditional roller coasters travel along rail tracks and provide their riders with stationary seats or harnesses which fix the motion of the riders to the direction of travel of the cars.

The overall effect attained by traditional roller coasters is to statically couple riders to the cars and, therefore, sense essentially the same motions in gravitational forces experienced by the cars in which they ride. Due to the static nature of the ride, each ride provides the same ride sensation and experience every time it is ridden.

Some amusement devices, including roller coasters, attempt to deliver additional systems of rotation other than the movement of the vehicle on the track system. Examples of amusement rides which provide some rotation capabilities with or without passenger control are various patents to Mares including U.S. Pat. Nos. 5,791,254, 6,098,549 and 6,227,121.

WO 03/082421 teaches an amusement ride, such as a roller coaster or a vertical track ride, which enables full rotation in at least two planes or axes, and preferably all three planes or axes.

The WO 03/082421 amusement ride generally comprises a track system, which may be an endless roller track or at least one vertical tower track. An attachment assembly, such as a bogey, is movably connected to the track system. A vehicle assembly is connected to the attachment assembly and includes a seat assembly having at least one rider seat. The vehicle assembly includes means for fully rotating the seat assembly about first, second and third axes independent of the track system, and preferably independent of one another.

In one 421 embodiment, the vehicle system includes a first arm extending from the attachment assembly and operably coupled to an actuator such that the first arm is freely or selectively rotatable about a first axis. The firm arm may comprise a generally semi-circular arm attached to a yaw actuator whereby yaw rotation is imparted to the arm. Alternatively, the first arm comprises a shaft extending from the attachment assembly and coupled to a yaw actuator. A second arm is rotatably connected to the first arm by an actuator such that the second arm is freely or selectively rotatable about a second axis independent of the first arm. Typically, the second arm extends generally transverse from an end portion of the first arm and supports at least one seat assembly. A roll actuator is operably connected to each seat assembly such that roll rotation is imparted to the seat assembly. Thus, the seat assembly is capable of yaw, pitch, and roll rotations over all three axes.

In another 421 embodiment, the vehicle assembly comprises a generally circular main ring housing that is rotatably connected to the attachment assembly. Typically, a yaw gear of a gear assembly interconnects the attachment assembly and the vehicle assembly whereby yaw rotation is imparted to the main ring housing, and thus the seat assembly. A pitch arm extends between opposing sides of the main ring housing and supports the seat assembly. The pitch arm is rotatable along a second axis independent of the track system. A gear of the pitch bar mates with a pitch gear of the gear assembly to impart such pitch rotation. A split inner race assembly including rollers is disposed within the main ring housing and connected to the pitch bar. The split inner race assembly is operably coupled to a roll gear of the gear assembly, whereby roll rotation is imparted to the split inner race assembly, and thus the seat assembly.

In another 421 embodiment, the vehicle assembly comprises an arm extending from the attachment assembly, such as a semi-circular arm, which is rotationally coupled to a gyroscope assembly that supports the one or more seats of the seat assembly therein. The gyroscope structure or assembly comprises a first generally circular ring coupled to the semi-circular arm by an actuator that imparts rotation to it, and thus the seat assembly, about a first axis. A second generally circular ring is disposed within the first ring and is coupled thereto by an actuator that imparts rotation about a second axis. A third ring may be used which is disposed within the second ring and rotatably coupled to the second ring by an actuator that imparts rotation to the seat assembly about a third axis. Alternatively, the arm is rotatably coupled to the attachment assembly to provide the third degree of rotation.

The important aspect of this 421 invention is that the seats be fully rotatable in at least two, and preferably all three, planes or axes. Although such rotation may be free and dependent upon the change of acceleration placed upon the seat assembly, typically the actuators are mechanically driven or powered to selectively rotate the seat assembly. When powered, the rotation of the seat may be altered by pre-defined programs or even rider control.

A historic summary of relevant prior art patents follows below:

U.S. Pat. No. 3,120,197 (1964) to Cirami discloses a ground-traveling people-carrying robot with a pilot track used for steerage. A power rail supplies electric power to the motorized robot. A yoke arm from the robot has a wheel connection to the power rail and a roller clamp connection to the pilot track.

French Patent 2098914 (1972) discloses a central pivot marry-go-round type ride having peripheral tires which rock a rider compartment. Each outer tire has an outer axle which supports a rod which carries the rider compartment.

U.S. Pat. No. 3,985,081 (1976) to Sullivan, II discloses a people mover mounted on a post with a horizontal top rail, wherein the supporting sides of the top rail are used for supporting canted weight-bearing wheels. A rider compartment is supported outbound of the post (FIGS. 1,2,) by a strut (20) supported by the wheels.

French Patent 2599988 (1987) discloses a roller coaster concave track, wherein a large ball rolls down the track. Passengers are seated inside the large ball.

U.S. Pat. No. 6,047,645 (2000) discloses a square roller coaster truss track, and FIG. 4 discloses a three-tube truss track. There are two parallel running rails 52,54 which support (see FIG. 10) a chassis beam with a rail clamp at each end. Each rail clamp has an array of three wheels to ride along the rail. Thus, the passenger compartment, which is side-mounted to the running rails 52, 54, is supported by the two arrays of wheels and the interconnecting chassis beam. A single support rail 56 runs parallel to the two running rails 52,54 and has interconnected frame elements 60 to secure the three-tube truss track together.

The present invention provides a relatively quiet, smooth yet exhilarating ride. The track can be designed for the level of excitement desired, from flat to loop layouts. A ferris wheel type rocking motion is included combined with a roller coaster thrill. An optional "flip the rider in a full circle" feature may be included. Also the rider is not encased in a car, but rather sitting exposed to the surroundings. This free flight and relatively quiet ride creates a bird-like feeling unique in amusement rides.

SUMMARY OF THE INVENTION

An aspect of the present invention is to provide a large wheel running over a roller coaster track so as to support a rider compartment from the axle.

Another aspect of the present invention is to provide a relatively flat layout of a track with a motor powering the large wheel, creating a people mover.

Another aspect of the present invention is to provide the running track with a pilot rail and structural support rail in a triangular cross-sectional shape for the track assembly.

Another aspect of the present invention is to design the wheel axle to be the support for a rider compartment.

Another aspect of the present invention is to design the rider compartment into a side-by-side pair of seats that let the rider fly freely through the air.

Another aspect of the present invention is to provide a flipping (head over heels or forward or backward somersault) feature for the rider compartment.

Another aspect of the present invention is to provide a group of coupled large wheel devices to form a train.

Other aspects of this invention will appear from the following description and appended claims, reference being made to the accompanying drawings forming a part of this specification wherein like reference characters designate corresponding parts in the several views.

The wheel support rail is a pipe about four inches wide with the large wheel being also about four inches wide. A quiet, smooth weight-bearing wheel is designed. The wheel axle extends several feet off to the side of the wheel to provide a support for a pair of seats. To counterbalance the seats, a steerage assembly (called a pilot car) connects the large wheel axle to a pilot rail that runs parallel to the wheel support rail. The steerage assembly consists of a plurality of brackets extending from the large wheel axle to a base that travels on two or more support clamps having roller wheels running on the pilot rail. A safety bar encircles both the wheel support and the pilot rails to secure the large wheel should the steerage assembly fail.

A structural support rail completes the third member of the rail assembly which is supported by interconnecting brackets.

A shield may separate the large wheel from the rider seats. In a roller coaster ride the riders fly around the course with nothing in front of them. They will also rock back and forth (optionally) with a gimbaled axle and/or spin. Thus, each ride should be somewhat different with the rocking motion, and each ride should be stimulating at roller coaster speeds with nothing in front of the rider.

In a people mover design the rail assembly could be installed around a park. Each car is separately powered. A controller could automatically keep a safe distance between the large wheels for loading and unloading.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
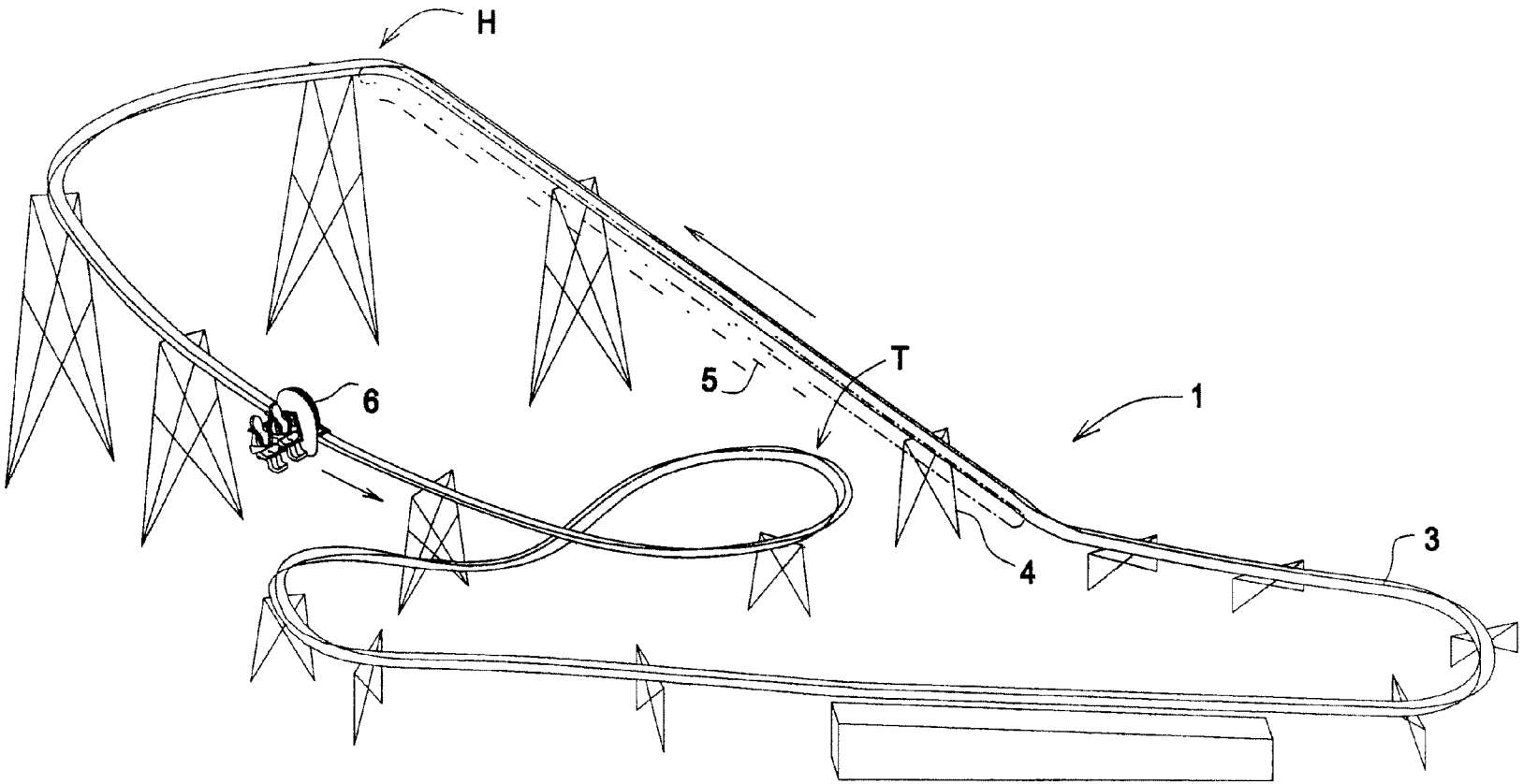
FIG. 1 is a side perspective view of a roller coaster layout using one embodiment of the rail and large wheel conveyance.

Referring first to FIG. 1 the roller coaster layout 1 consists of a loading platform 2 and a rail assembly 3 laid out with a high point H. A series of towers 4 support the rail assembly 3. A lift chain 5 lifts the large wheel conveyance 6 to the high point H and then releases the conveyance 6 to travel the circuit and stop at the loading platform 2. Banked turns at T provide a free flight sensation since the riders are projected tangentially while seated in a seat rather than in a roller coaster car.

Figure 2:
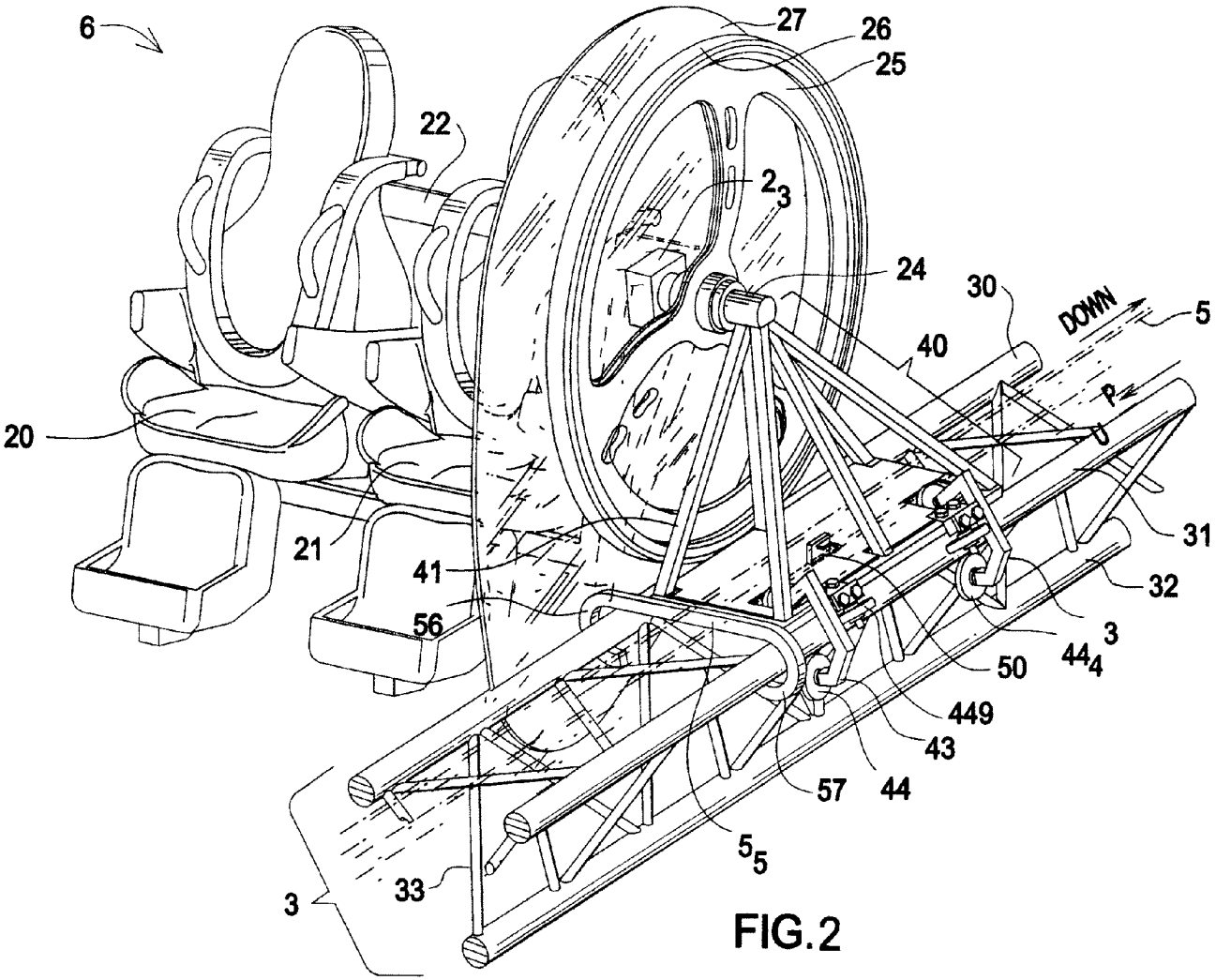
FIG. 2 is a side perspective view of the large wheel conveyance and the rail assembly.

Referring next to FIG. 2 large wheel conveyance 6 has a large wheel 25 with a tread 26 that rides on carriage support rail 30. The axle 24 supports a gimbaled bearing 23 which in turn supports a frame 22. The frame 22 supports a pair of standard amusement ride seats 20,21. A safety screen 27 separates the seats 20,21 from the wheel 25.

The rail assembly 3 consists of the carriage support rail 30, the pilot rail 31 and the structural support rail 32. Braces 33 connect the rails 30,31,32 into a strong structural rail assembly 3.

A steerage assembly (pilot car) 40 connects the axle 24 to the rail assembly 3. The steerage assembly 40 consists of brackets 41 that are connected to the axle 24 at a first end, and are connected to a base 42 at a second end. The base 42 has a pair of C clamps 43, each of which has a plurality of roller wheels 44/449 which run along pilot rail 31. Thus, the wheels 44/449 support the offset weight of the frame 22 along the axle 24 so as to counter balance the weight of the passengers and seats, and to steer the large wheel. The pilot car 40 maintains the large wheel 25 about perpendicular to the plane created by rails 30,31.

The base 42 also has an emergency hook 55 which has a hook end 56 hovering around rail 30, and a hook end 57 hovering around rail 31 in case of a failure of the steerage assembly 40, as well as to clear the track of debris.

The base also supports a controllable latch 50 that grabs the lift chain 5 on the UP links to lift the conveyance 6 to point H on FIG. 1. The DOWN links run on top of the rail assembly 3, wherein the UP links run down the center of the rail assembly 3. A conventional motor (not shown) runs the lift chain 5.

Figure 3:
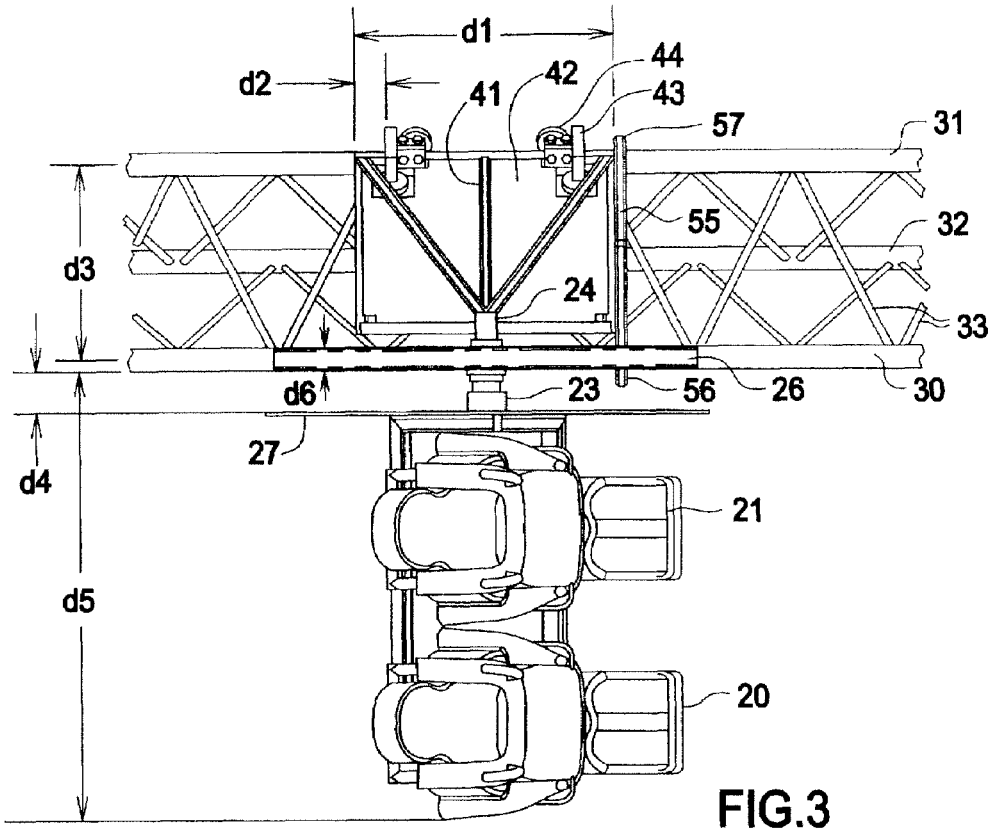
FIG. 3 is a top plan view of the FIG. 2 apparatus.
Figure 4:
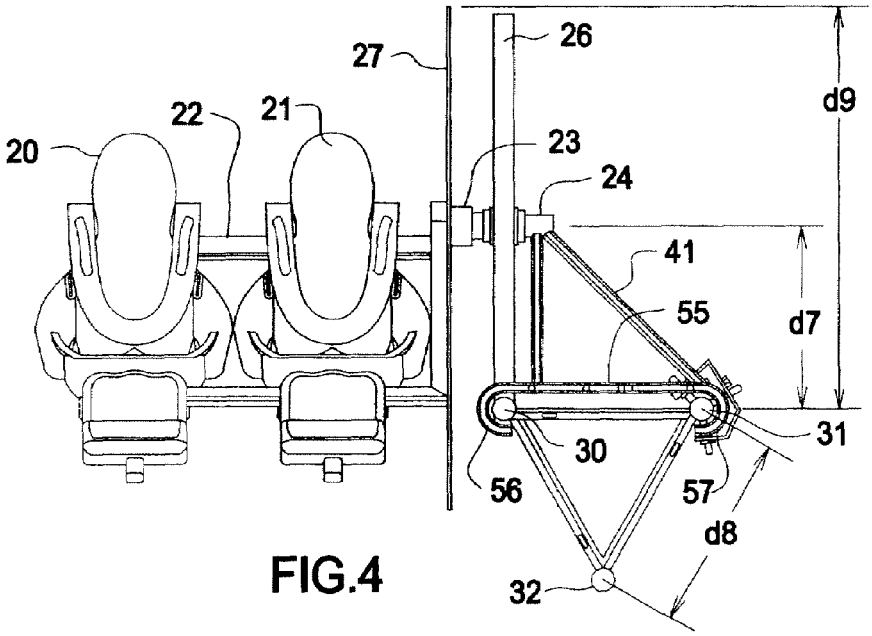
FIG. 4 is a front plan view of the FIG. 2 apparatus with the rail assembly in sectional view.

Referring next to FIGS. 3,4, nominal dimensions are $d_1$=2½", $d_2$=3", $d_3$=3' on center, $d_4$=6", $d_5$=5', $d_6$=4 inches, $d_7$=3 feet 2 inches, $d_8$=3' on center, $d_9$=6'.

Figure 5:
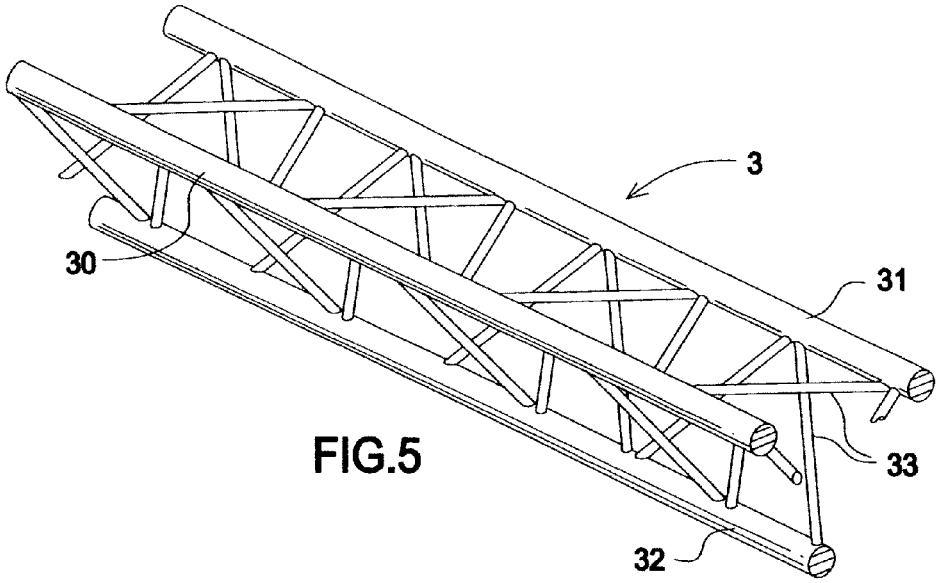
FIG. 5 is a top perspective view of the rail assembly.

FIG. 5 shows the rail assembly 3 constructed of three identical structural elements for rails 31,32,33. Engineering requirements for each layout determine these details.

Figure 6:
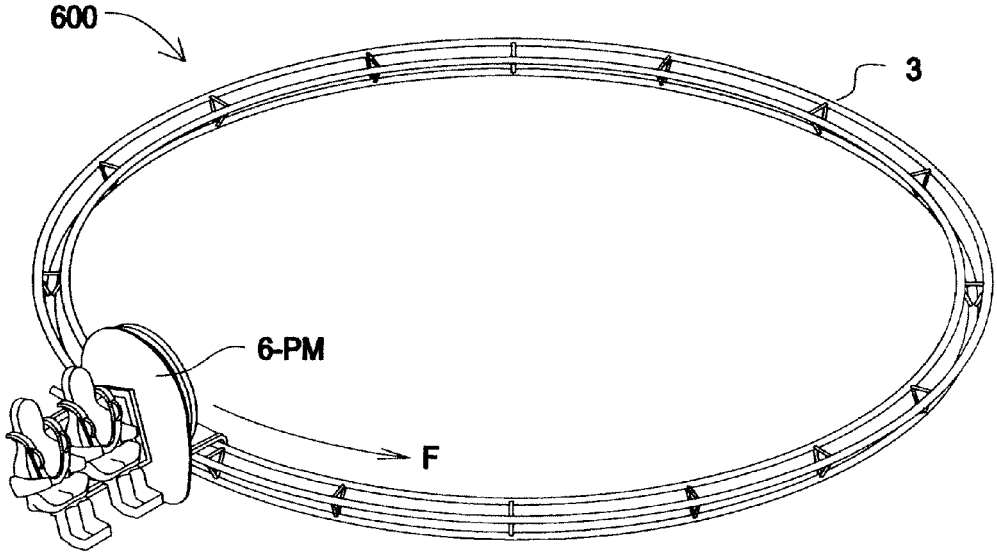
FIG. 6 is a top perspective view of a people mover layout.
Figure 11:
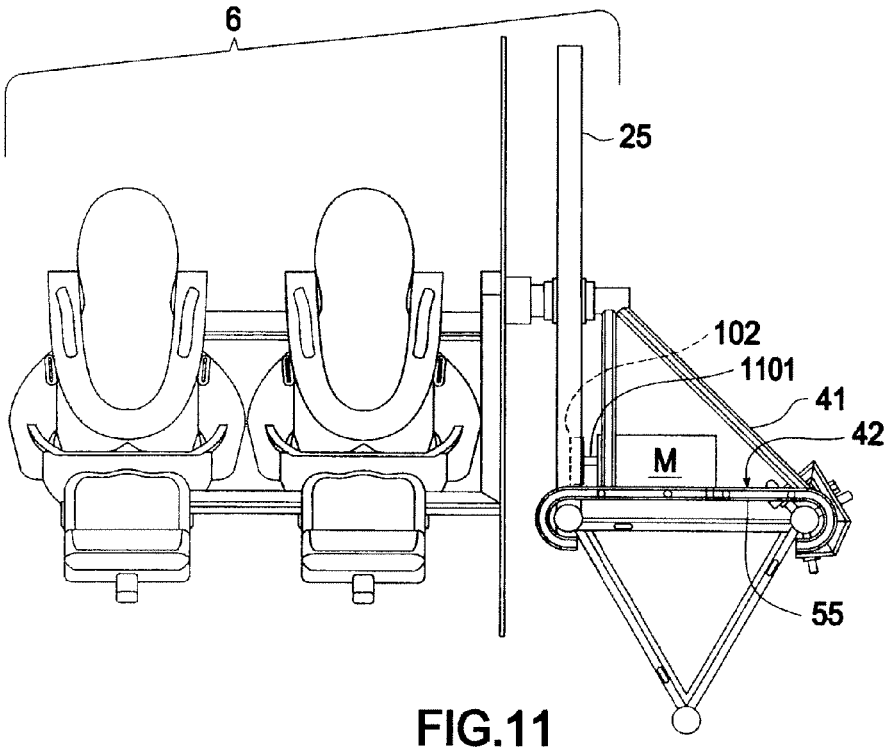
FIG. 11 is a perspective view of a motor in the FIG. 2 steerage assembly.

Referring next to FIG. 6 a people mover layout 600 consists of a relatively flat rail assembly 3. The conveyance 6-PM (people mover) is a modified conveyance 6 as shown in FIG. 11. A controller (not shown) starts and stops the conveyances 6-PM for loading/unloading.

Figure 7:
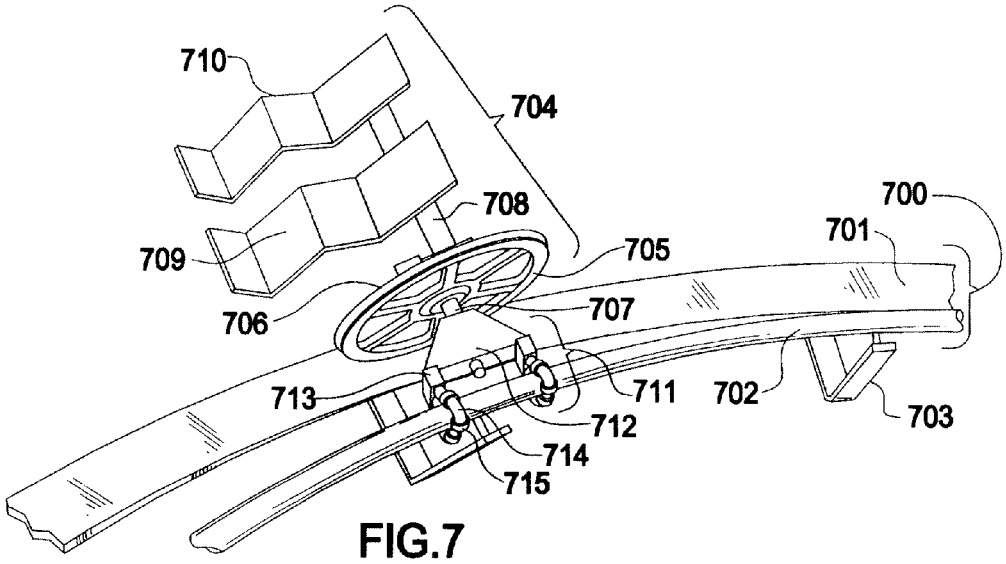
FIG. 7 is a top perspective view of an alternate embodiment flat track ride.
Figure 8:
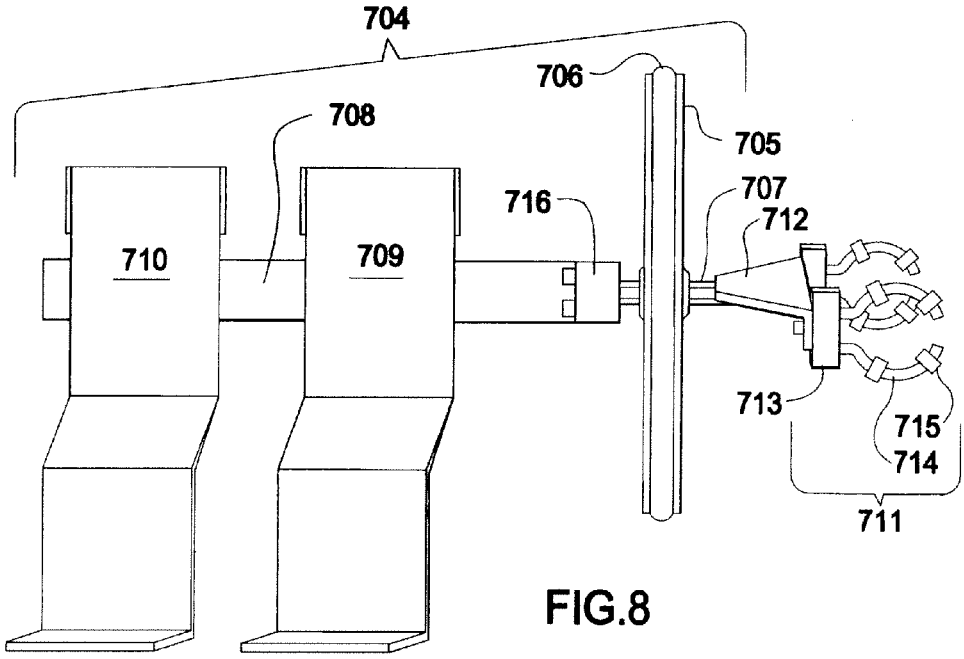
FIG. 8 is a front plan view of the alternate embodiment conveyance shown in FIG. 7.
Figure 9:
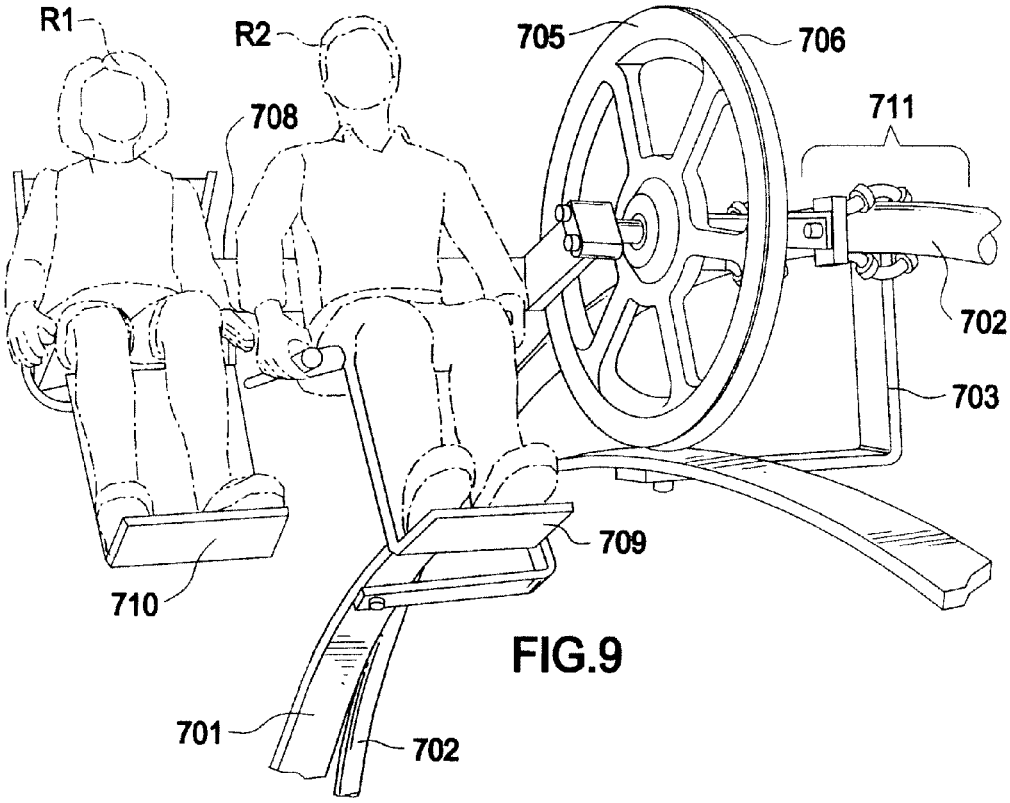
FIG. 9 is a bottom perspective view of the alternate embodiment shown in FIG. 7.

Referring next to FIGS. 7-9 an alternate embodiment amusement ride/people mover is shown. The rail assembly 700 consists of a flat track 701 with a parallel pilot rail 702. A guardrail 703 structurally connects members 701,702 in a parallel fashion. The conveyance 704 consists of a large wheel 705 with a tread that rides on track 701. The axle 707 supports a frame 708 which has seats 709,710 connected thereto. To counterbalance the weight of frame 708 the pilot rail 702 is used. A steerage assembly 711 connects the axle 707 to the pilot rail 702. The steerage assembly 711 consists of a base 712, brackets 713 and C clamps 714 having roller wheels 715.

FIG. 8 shows the optional gimbaled bearing 716 to provide a rocking motion.

FIG. 9 shows riders $R_1$, $R_2$ experiencing a free flight ride.

Figure 10:
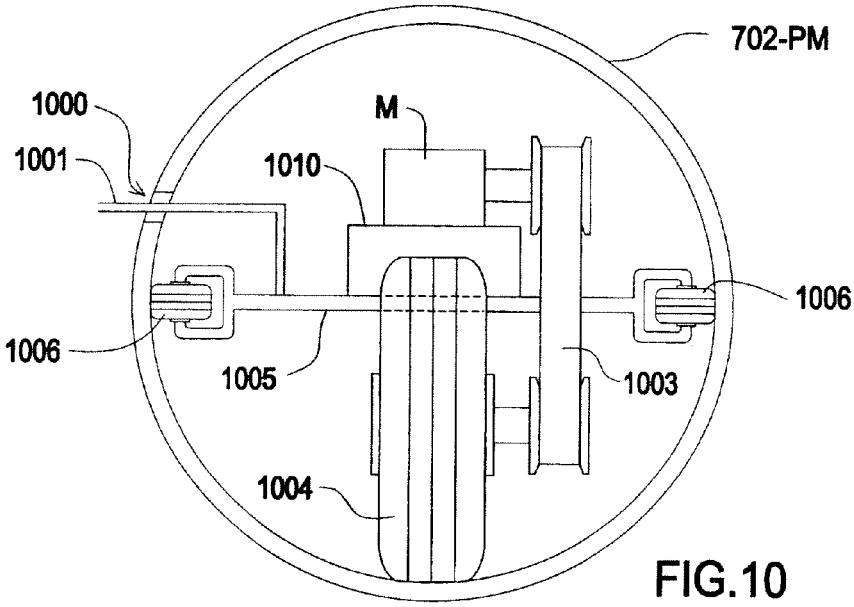
FIG. 10 is a cross sectional view of a pilot rail for a people mover with a powered robot in the pilot rail to move the large wheel conveyance.

FIG. 10 shows a people mover embodiment, wherein the pilot rail 702 is now numbered 702-PM (people mover). A slot 1000 provides an opening for a drive arm 1001 which connects to the conveyance 704. A motor M powers a drive wheel 1004 via a belt 1003. A stabilizer bar 1005 has wheels 1006 keeping the frame 1010 about centered in the rail 702-PM.

FIG. 11 shows the conveyance 6 used as a people mover by connecting it to a powered steerage assembly 1100. The assembly 1100 has a base 42 supporting a motor M that has a shaft 1101 driving a roller 1102 against the inner periphery of wheel 25.

Figure 22:
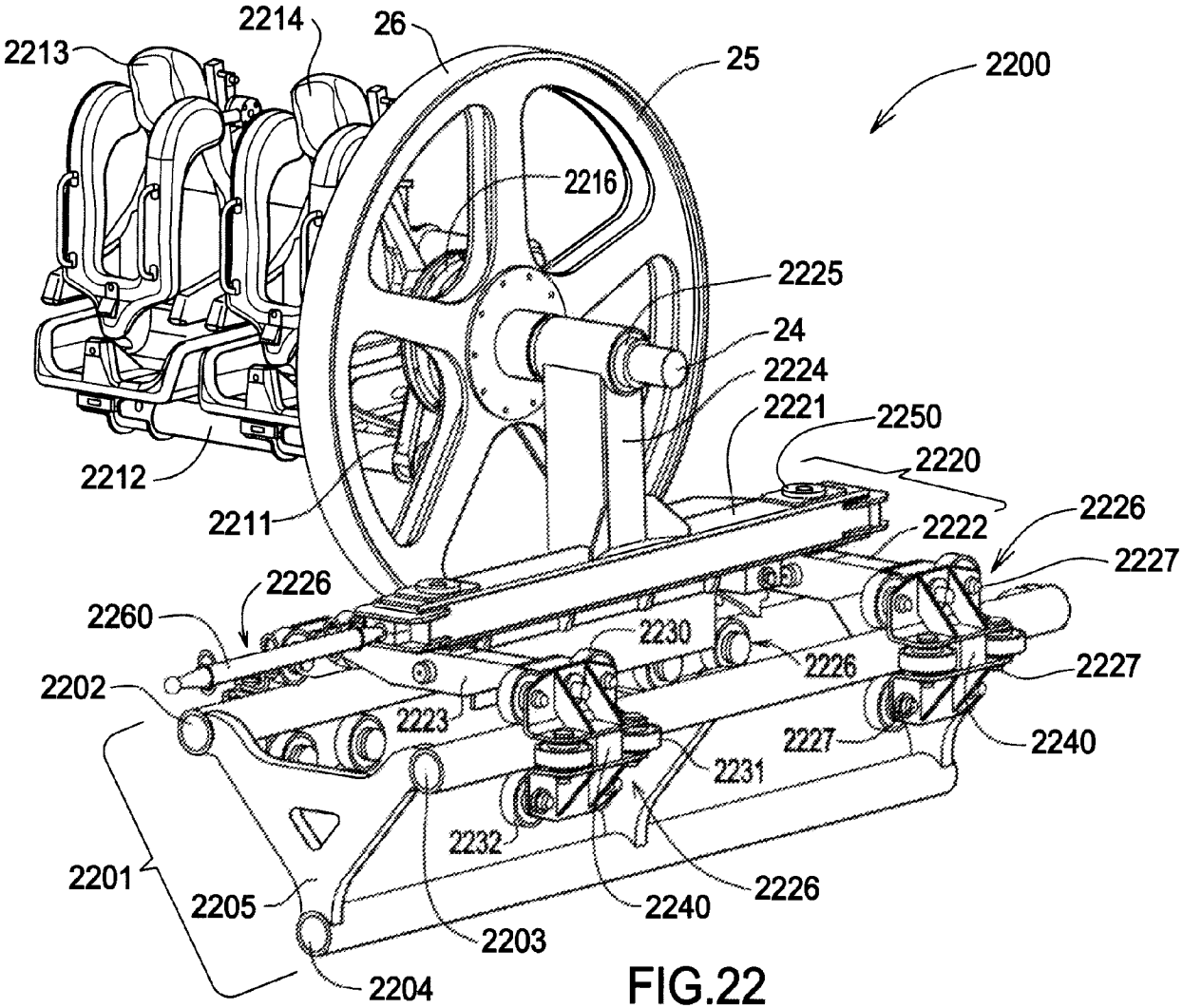
FIG. 22 is a side perspective view of another embodiment of the rail and large wheel conveyance.

The term roller coaster ride used herein describes the embodiments of FIGS. 1,7 and 22. The term large wheel used herein includes any wheel which can support a rider via its control hub assembly. The control hub assemblies disclosed herein use an axle to support the rider conveyance. Multiple wheels in parallel as used in trucks are covered under the definition of a wheel used to support a rider conveyance via a hub assembly.

A hub assembly could be designed around the axle so as to be part of the wheel frame, not directly part of the axle, and still functioning equivalent to axles shown in FIGS. 1,7 and 22.

Figure 12:
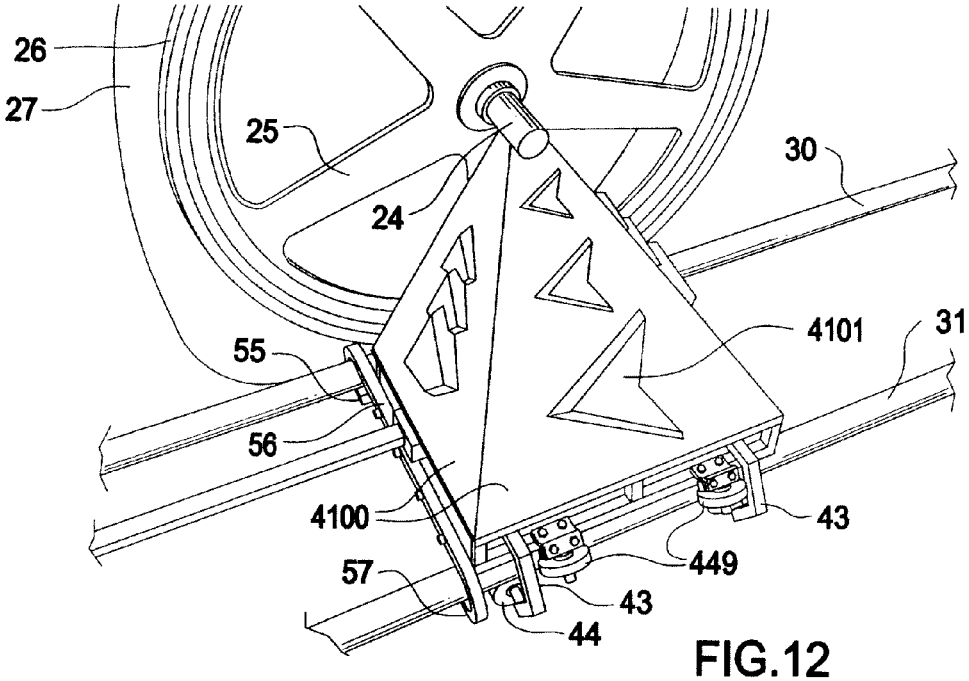
FIG. 12 is a top perspective view of an alternate embodiment pilot car assembly cover.

Referring next to FIG. 12 the structural brackets 41 of FIG. 2 have been replaced with and/or covered with walls 4100. Markings 4101 are decorative.

Figure 13:
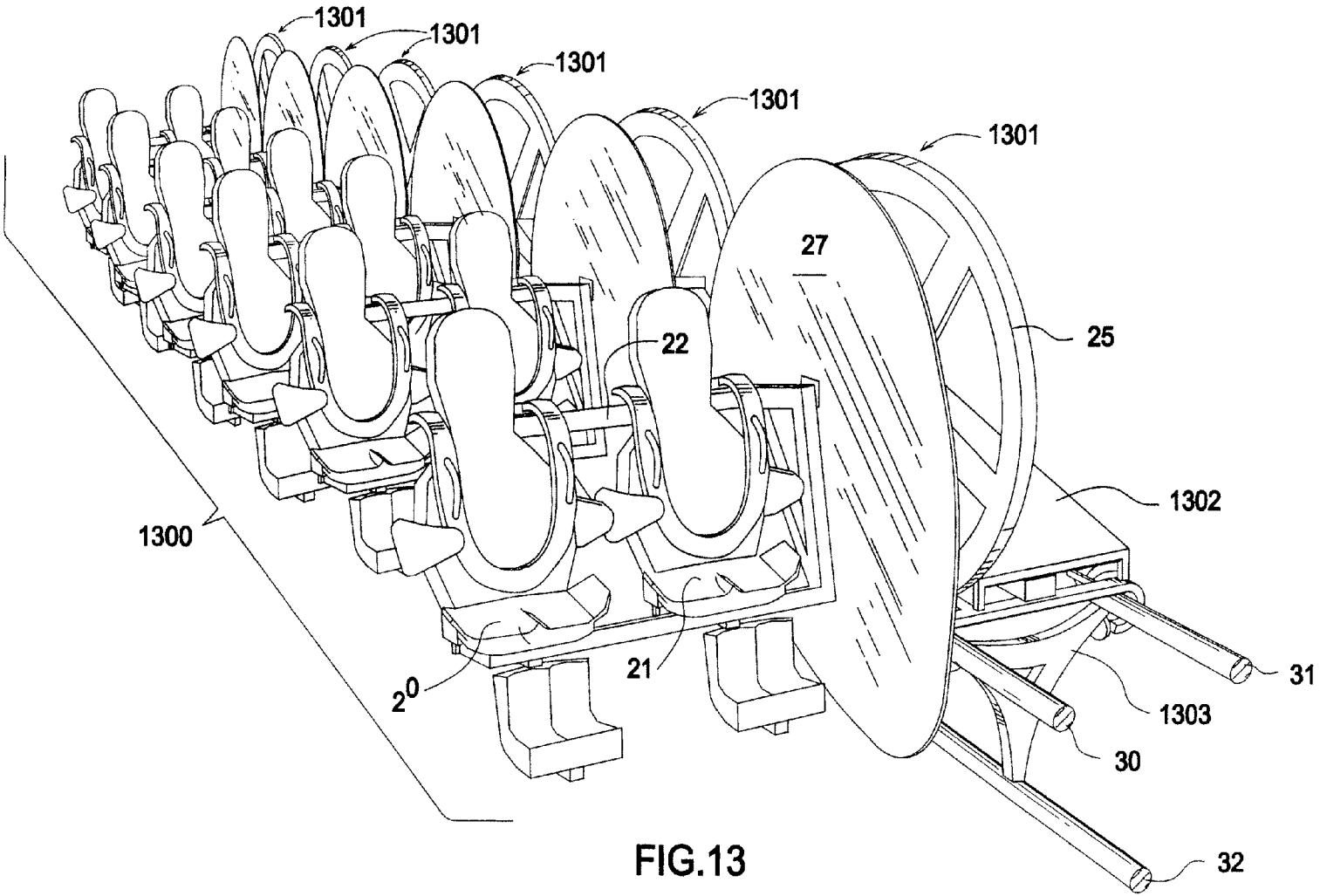
FIG. 13 is a front perspective view of a train embodiment large wheel ride.
Figure 14:
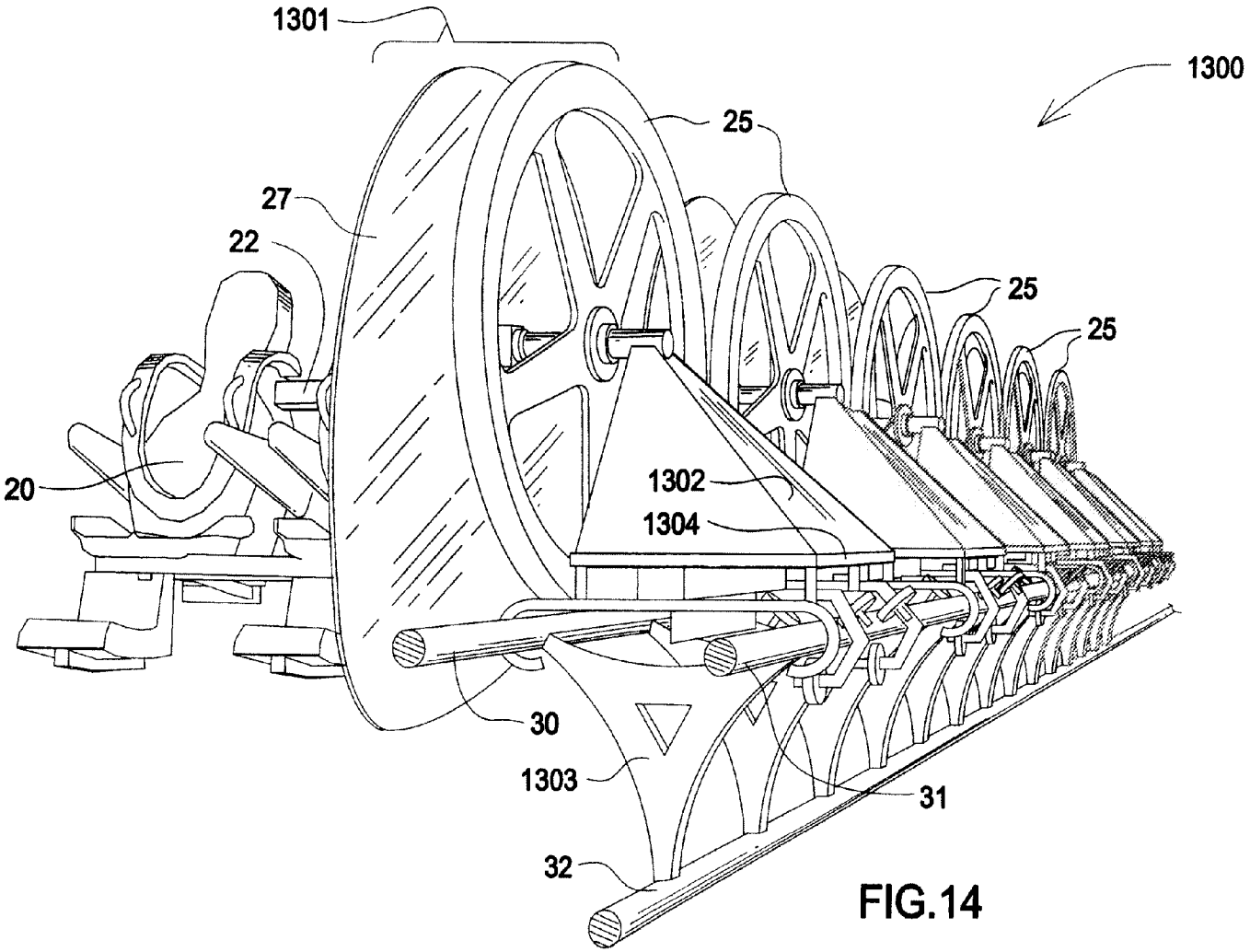
FIG. 14 is a side perspective view of the FIG. 13 embodiment.

Referring next to FIGS. 13, 14 a "train coaster" embodiment 1300 consists of a series of large wheel conveyances 1301 joined together by their respective pilot cars 1302. Any manner of bolting the bases 1304 of pilot cars 1302 together will allow joining a desired number of conveyances 1301 together. A triangular brace 1303 is used to join members 30, 31, 32.

Figure 15:
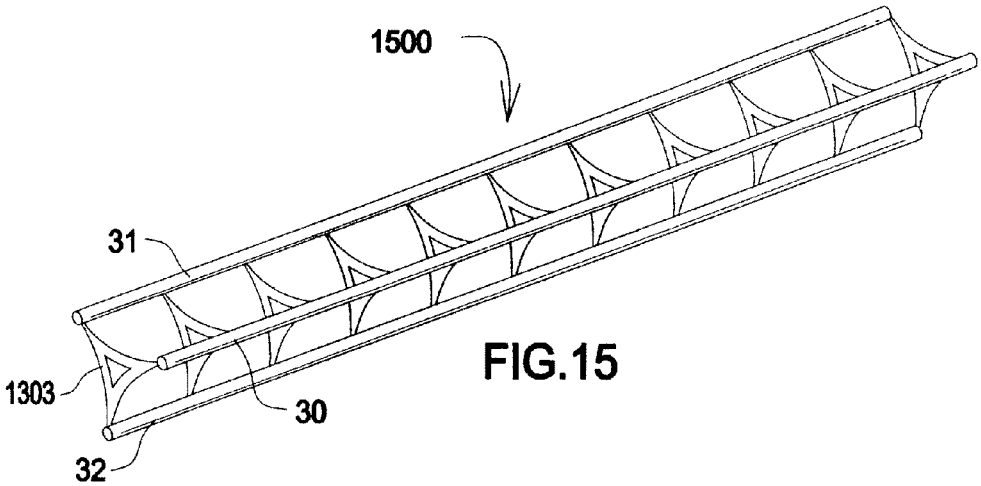
FIG. 15 is a side perspective view of a straight rail assembly.
Figure 16:
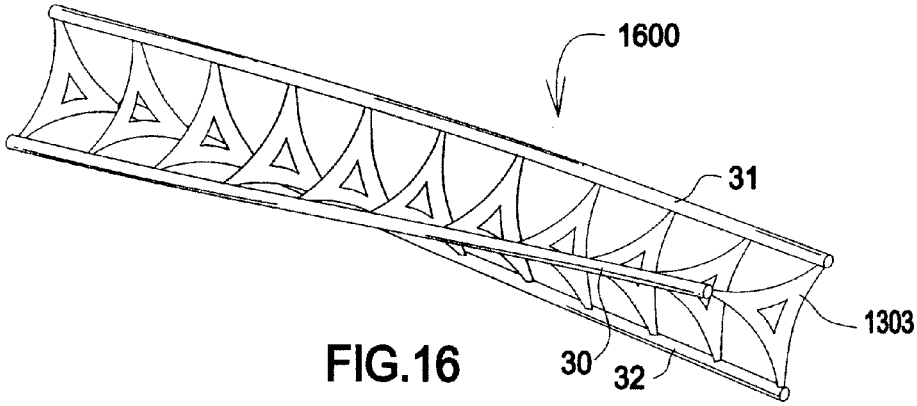
FIG. 16 is a side perspective view of a left twist rail assembly.
Figure 17:
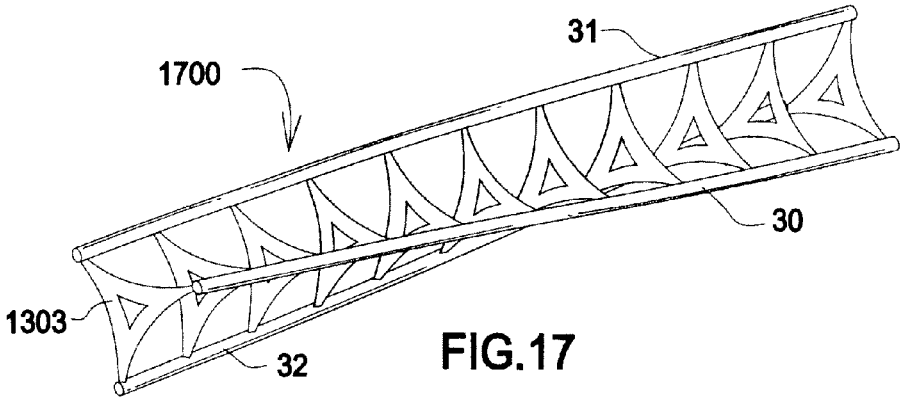
FIG. 17 is a side perspective view of a right twist rail assembly.

In FIG. 15 a rail assembly 1500 has a straight support rail 30. In FIG. 16 a rail assembly 1600 has a left twist support rail 30. In FIG. 17 a rail assembly 1700 has a right twist support rail 30. All three assemblies 1500, 1600, 1700 can be combined on a layout as shown in FIG. 20.

Figure 18:
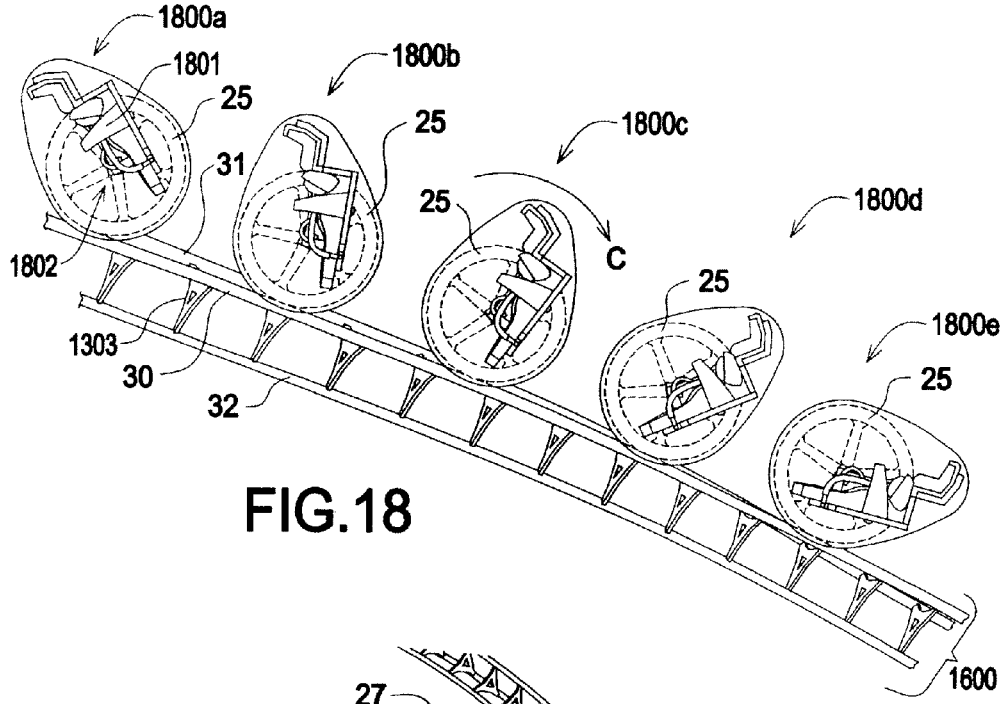
FIG. 18 is a side plan view of a flip type rider conveyance.

Referring next to FIG. 18 the flip feature has been added to each large wheel conveyance 1301, wherein each rider compartment 1801 is rotated clockwise c as powered by the rotation of the large wheel 25. A reduction gear hub assembly 1802 is actuated either by a rider control switch and/or a rail 1600 mounted remote activator. Numbers 1800 a-e represent a stage of flip. The hub assembly 1802 nominally has about a 3:1 reduction gear ratio of the rotation of the large wheel 25 to the axle 24 of the hub assembly 1802. On embodiment has a rider switch to hit "flip", and if the large wheel 25 has sufficient rotational speed, the engagement of the hub assembly 1802 to the axle 24 of the rider compartment 1801 flips the rider compartment clockwise one rotation with the wheel 25. If not enough speed exists of the large wheel, then the rider conveyance 1801 rocks. Another embodiment has a remote signal, perhaps track mounted, to activate a flip cycle at selected portions of the layout. Another embodiment allows the rider to deactivate the "flip" cycle via a switch.

Figure 19:
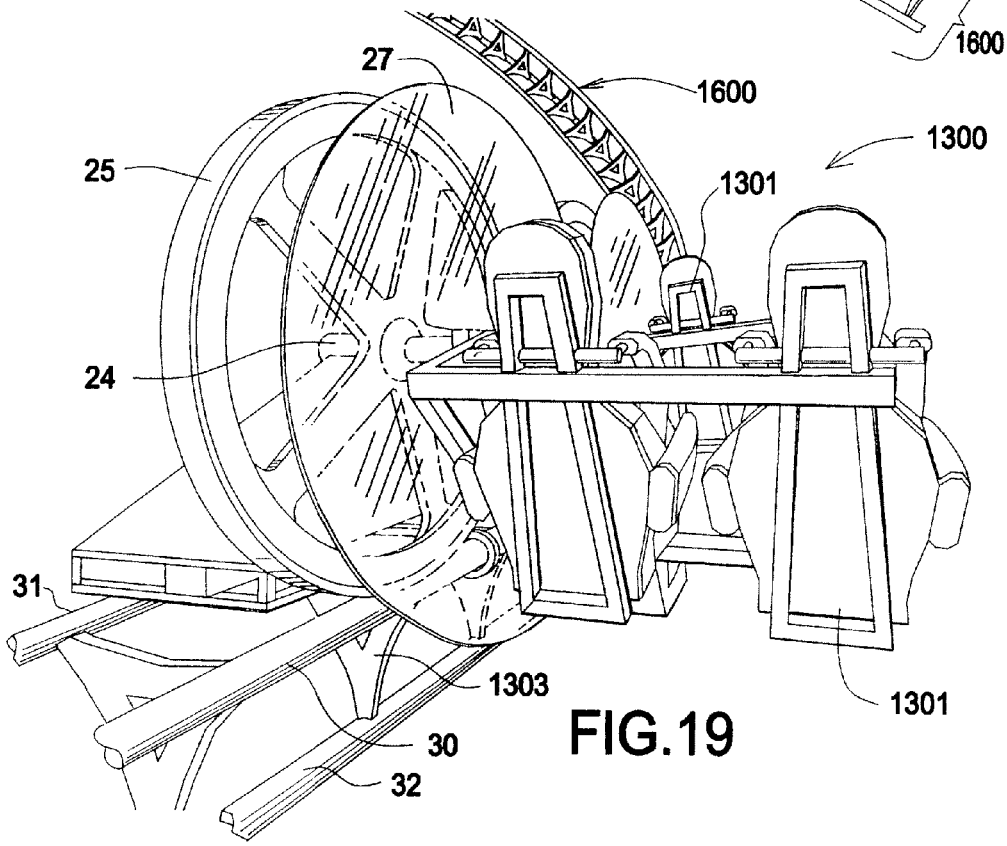
FIG. 19 is a rear perspective view of a two car train embodiment.

FIG. 19 shows a perspective rear view of a two car train 1300, wherein rail 1600 is twisting left and rising.

Figure 20:
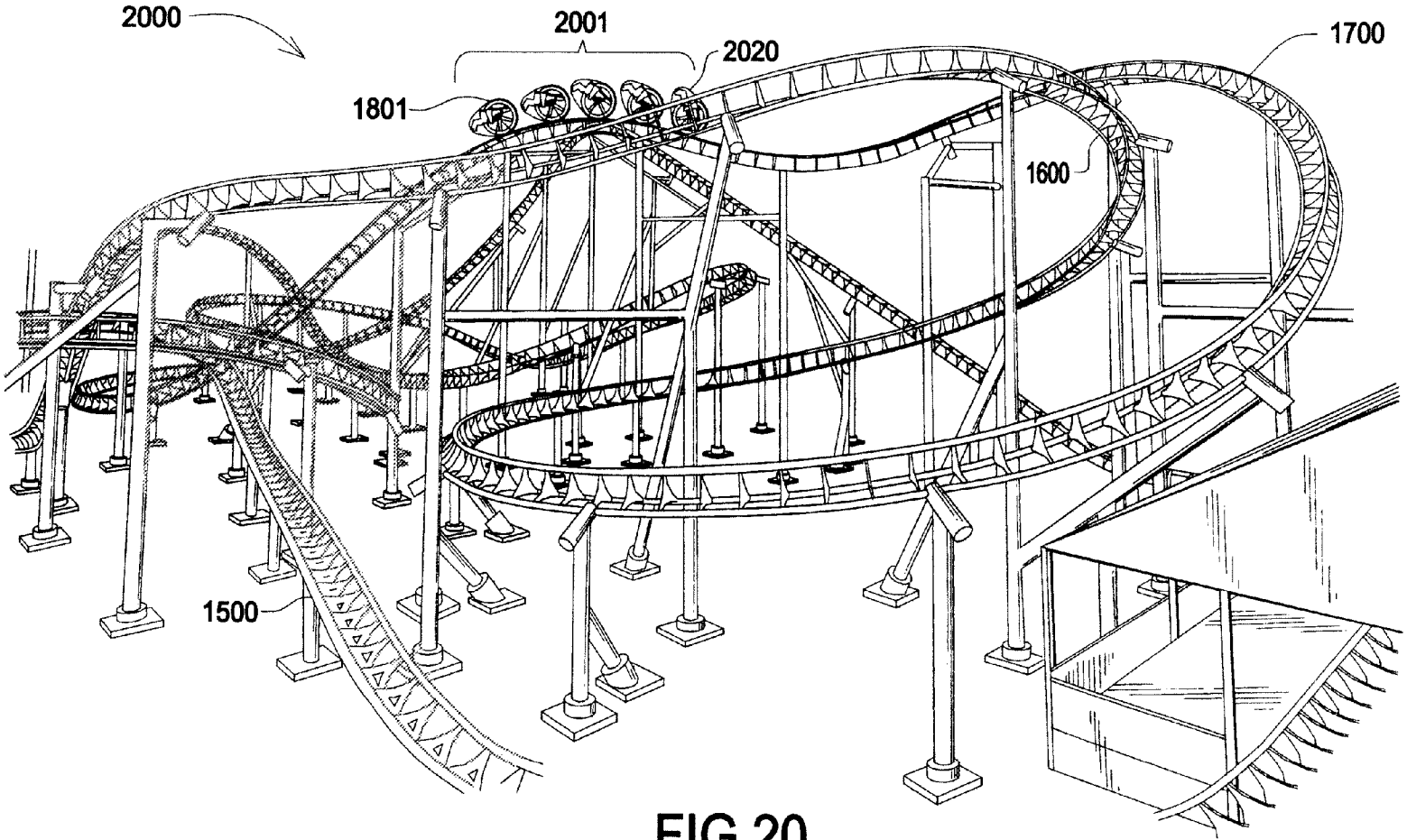
FIG. 20 is a front perspective view of a roller coaster layout with a spin type train rider conveyance.

Referring next to FIG. 20 a roller coaster layout 2000 has a five car train 2001 with flip type rider conveyances 1801. Rider conveyance 2020 is upside-down. Based on different flip cycle actuations, each ride can offer a new experience.

Figure 21:
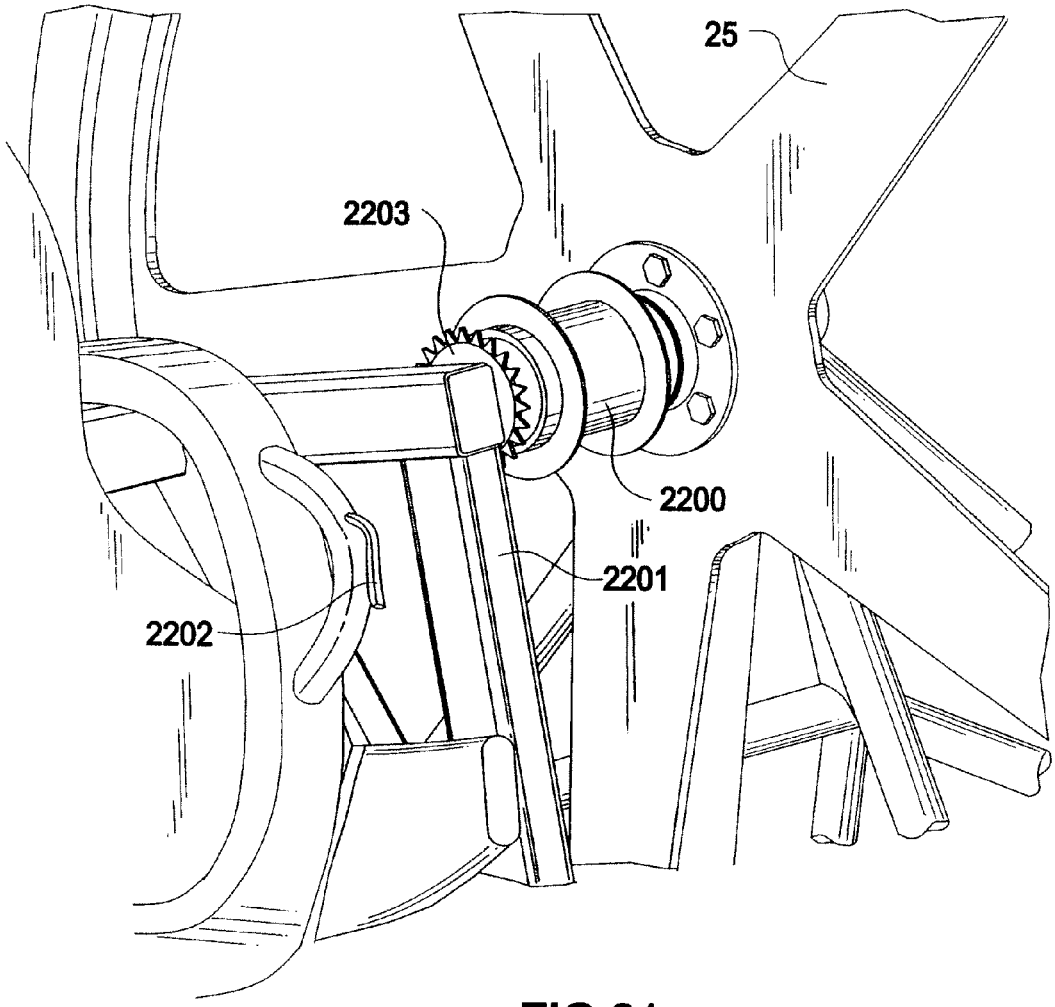
FIG. 21 is a perspective view of a flip hub assembly.

Referring next to FIG. 21 the wheel 25 is connected to the rider frame 2201 via a coaster brake assembly 2200. U.S. Pat. Nos. 5,967,938 and 6,840,136 are incorporated herein by reference to teach some of the prior art designs available for the means to flip the rider frame using the circular rotational momentum of the large wheel 25 as the driving force. The coaster brake assembly is activated to the lock (flip) mode via a rider controlled switch 2202. About a 1:4 or 1:3 rotation ratio from the large wheel 25 to the axle 2203 of the rider frame 2201 is desirable, otherwise too much G force is experienced by the rider. Other prior art equivalents to a coaster brake means for the spin hub include a belt driven means or a hydraulic clutch means. The gearing of the flip hub can be arranged for either a forward or a rearward flip. Another switch means could allow deactivation of the flip by the rider wherein a remote activated flip means (radio controlled coaster brake means) is deactivated.

Figure 23:
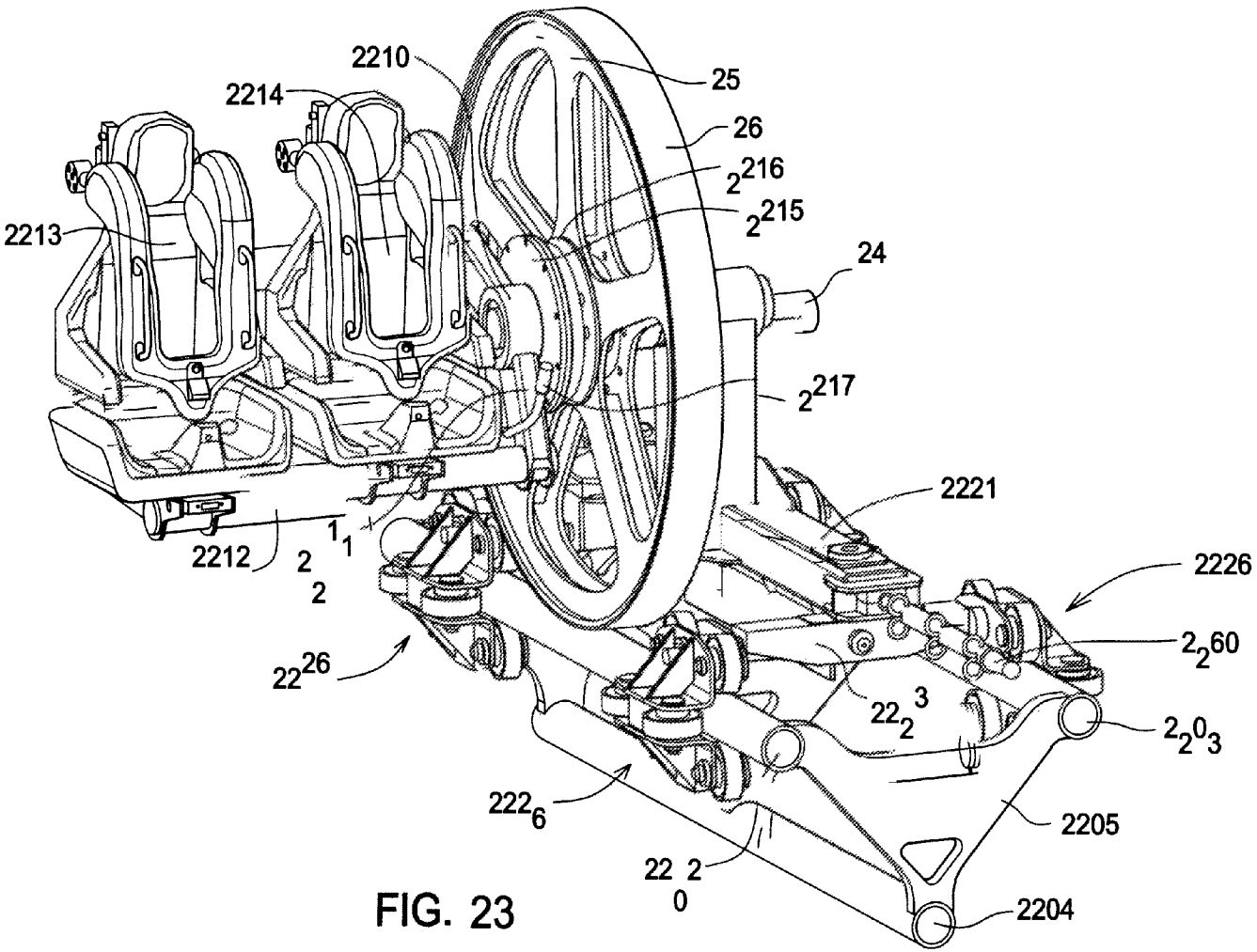
FIG. 23 is a front perspective view of the embodiment shown in FIG. 22.
Figure 24:
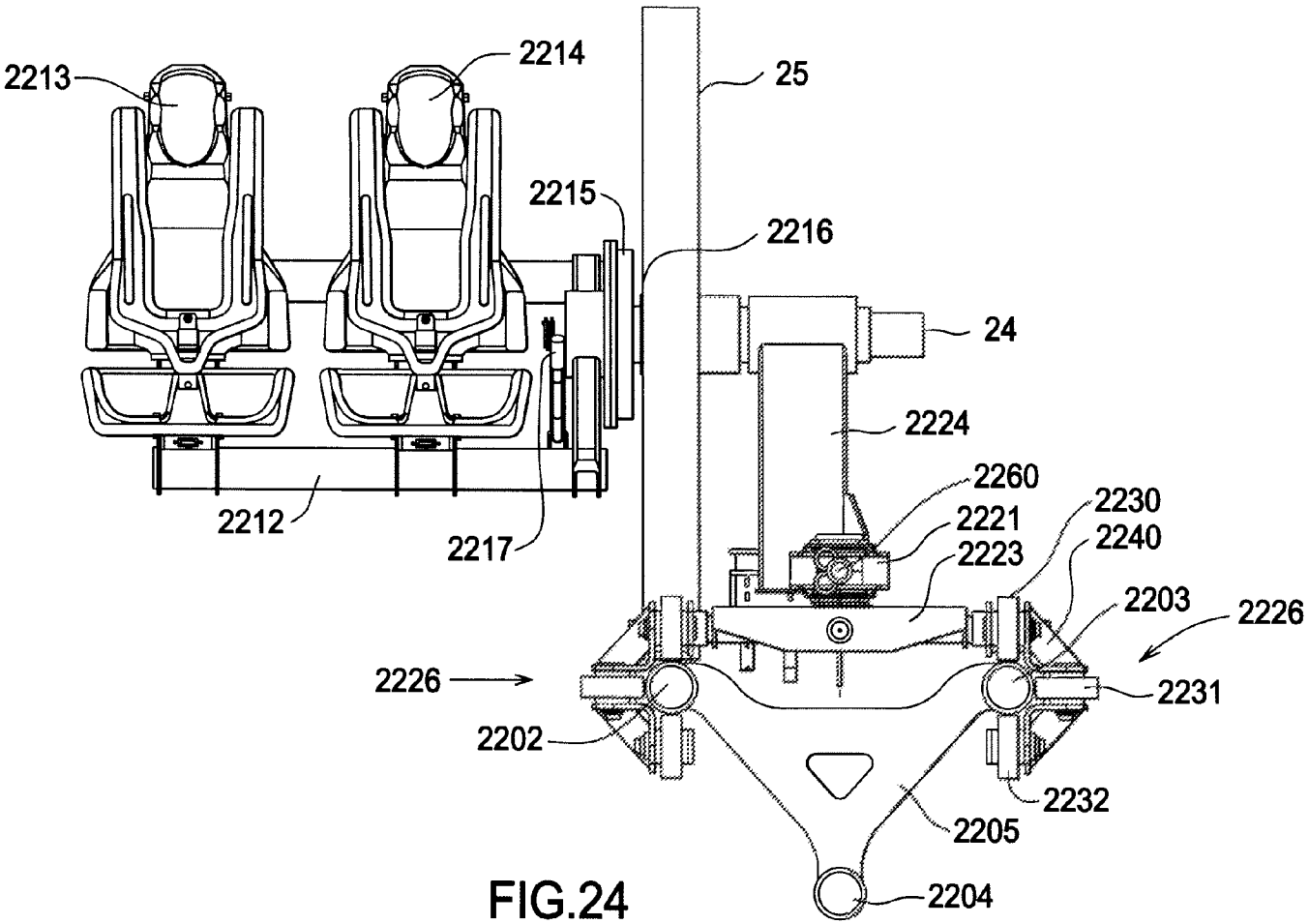
FIG. 24 is a front plan view of the embodiment shown in FIG. 22 with a sectional view of the track.
Figure 25:
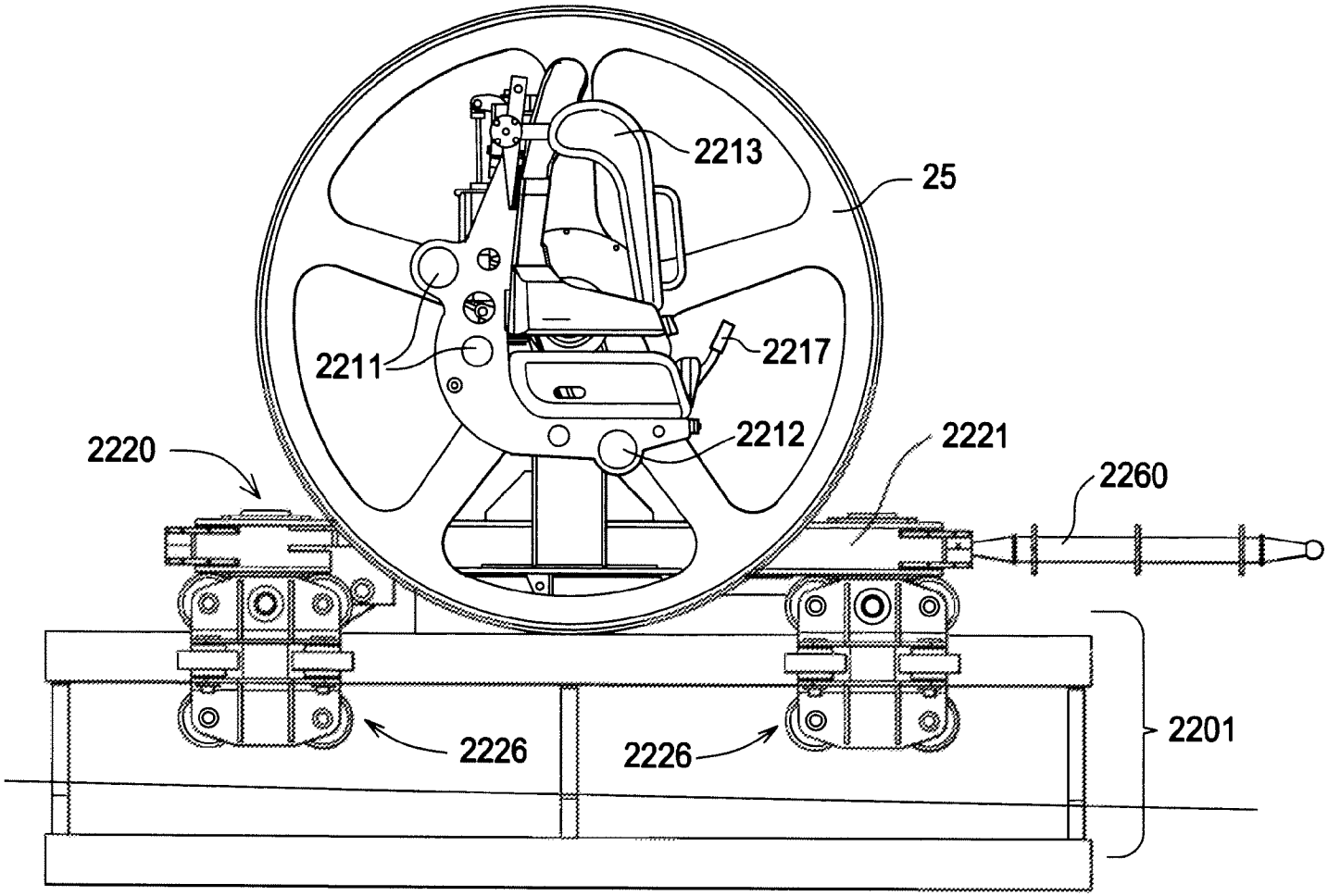
FIG. 25 is a left side plan view of the embodiment shown in FIG. 22.
Figure 26:
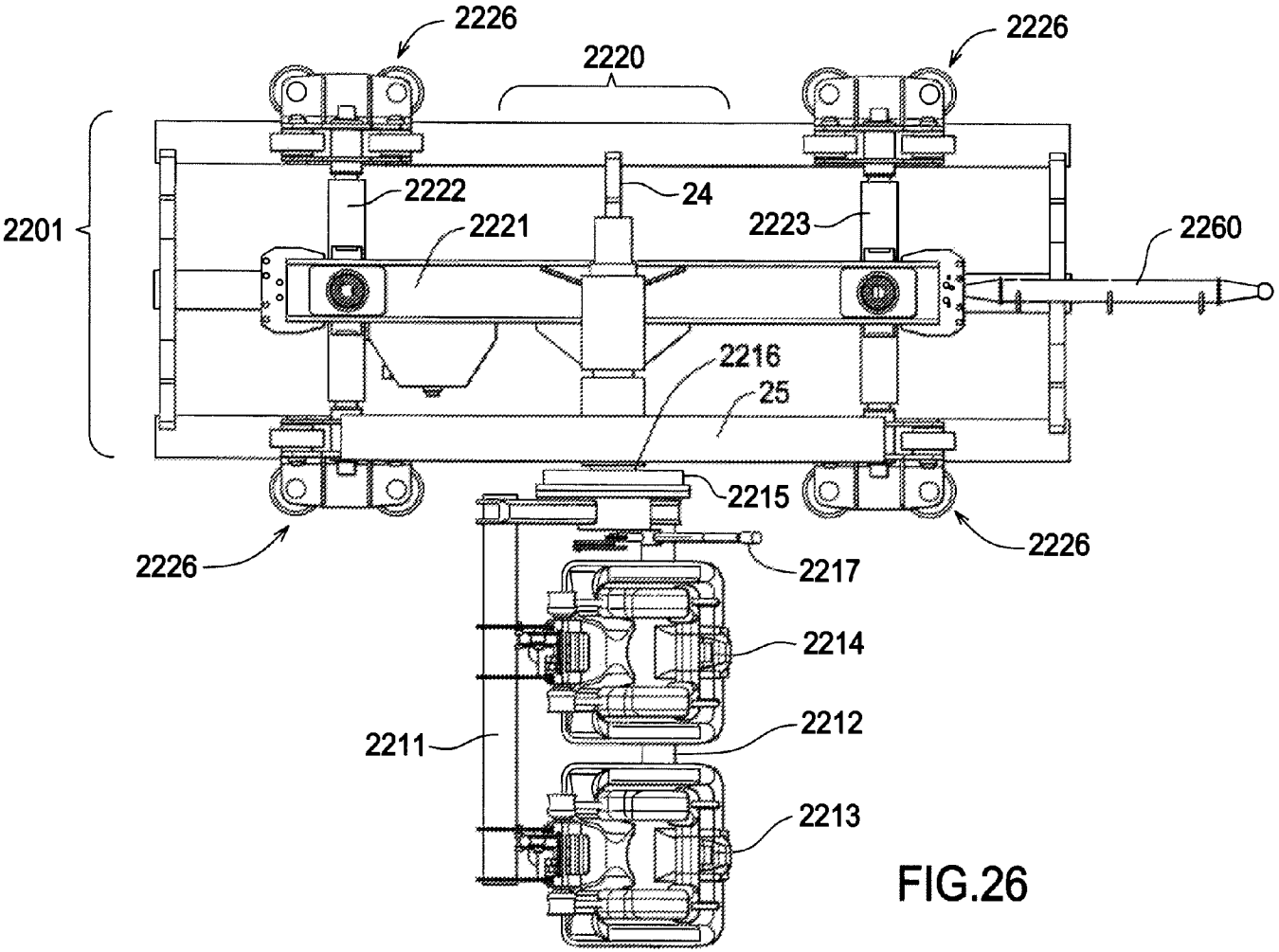
FIG. 26 is a top plan view of the embodiment shown in FIG. 22.
Figure 27:
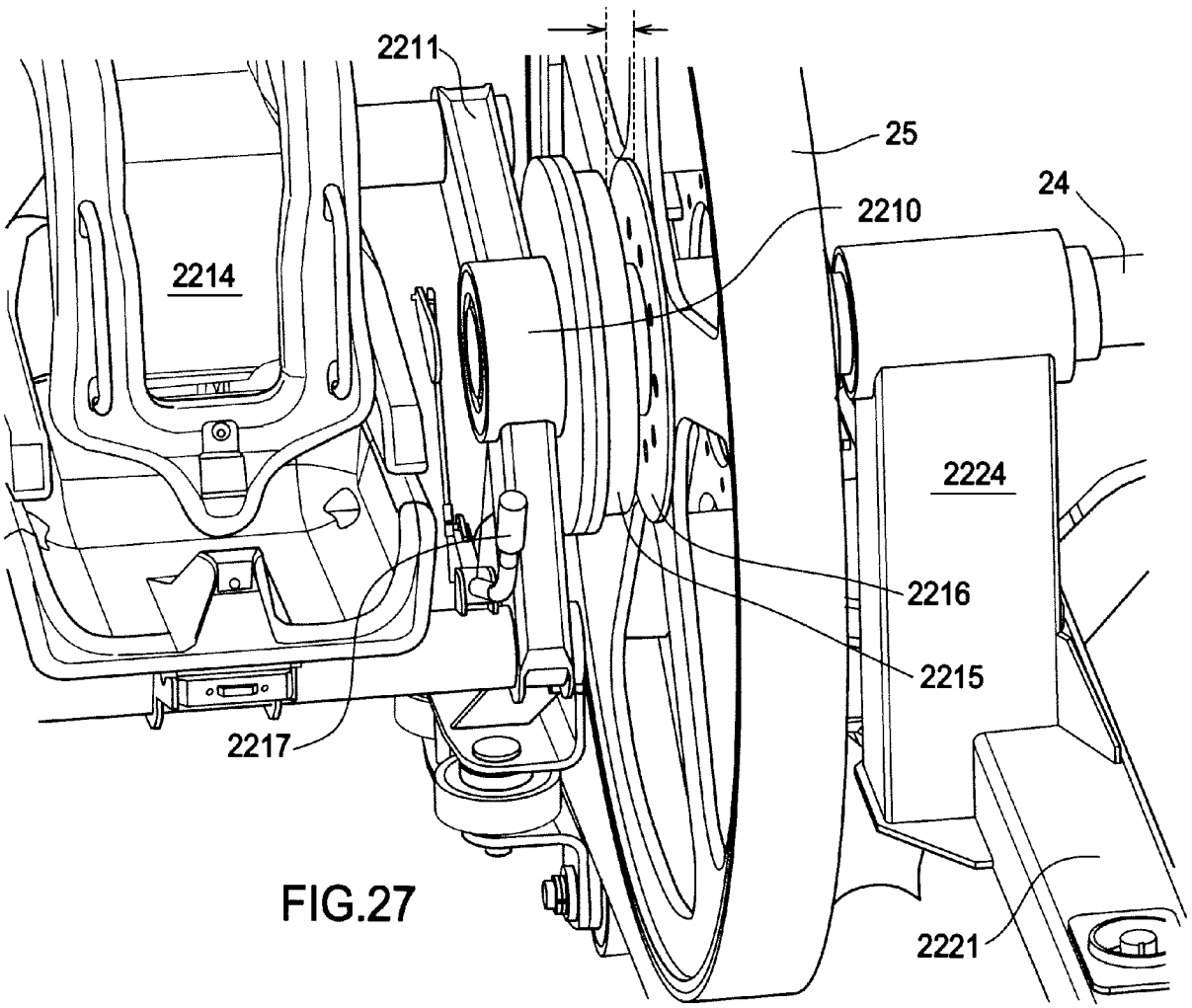
FIG. 27 is a close up view of a magnetic embodiment of the spin assembly.

Referring next to FIGS. 22, 23 a conveyance assembly 2200 comprises a triangular track assembly 2201 which supports a large wheel 25 with a tread 26 that rides on carriage support rail 2202. The axle 24 supports a bearing 2210 which in turn supports a conveyance frame 2211. The frame 2211 includes a support bar 2212 upon which rider seats 2213, 2214 are mounted.

The bearing 2210 has attached to it a plate shaped magnet 2215. The stator 2216 is permanently affixed to the wheel 25. Control handle 2217 allows a rider to move the magnet 2215 and bearing 2210 toward the stator 2216. When the magnet 2215 connects to the stator 2216, the bearing 2210 and frame 2211 rotate with the wheel 25.

The frame 2211 can either spin 360° and/or rock back and forth, depending on design force. When the magnet 2215 is close to the stator 2216, then the frame 2211 will rock back and forth as the stator 2216 partially propels the frame 2211 in the direction of motion of the wheel 25.

The rail assembly 2201 consists of the support rail 2202, a pilot rail 2203 and a structural support rail 2204, wherein a brace 2205 interconnects all three rails.

A support carriage 2220 rides along rail assembly 2201 and supports the axle 24. Strut 2224 is supported by longitudinal beam 2221. Strut 2224 supports the axle 24 and bushing 2225.

Suspension arms 2222 and 2223 are mounted to the longitudinal beam 2221. At each end of each suspension arm 2222 is mounted a roller support assembly 2226. Each roller support assembly 2226 has a frame 2240 with axles 2227 that support upper rollers 2230, side rollers 2231 and lower rollers 2232. Shock absorbers 2250 cushion the ride by clamping motion from the arms 2222, 2223 imparted to the beam 2221. A coupler 2260 connects to an adjoining conveyance assembly 2200.

Referring next to FIGS. 27, 29, 30, 31 the moving magnetic assembly is designated 3000. The fixed stator 2216 is affixed to the large wheel 25. The magnet 2215 moves toward and away from the stator 2216 as controlled by the rider's joy stick 2217. Not shown are optional remote triggers for the actuation of moving the magnet 2215 towards the stator 2216. A remote trigger could consist of a radio transmitter mounted to the track to emit a signal. A receiver gets the command signal and moves the magnet 2215 toward the stator 2216 using a hydraulic actuator instead of the joy stick 2217.

The joy stick 2217 has a pivot connection 3007 to the frame 2211. When the rider pushes the joy stick 2217 forward, the connecting rod 3008 pushes the cam roller 3009 up. When the cam roller 3009 is forced up, then its actuator rod 3004 rides up cam slot 3003 of the cam plate(s) 3002. The cam plate(s) 3002 are affixed to a thrust plate 3035 which in turn is attached to the magnet 2215. The thrust plate 3035 moves away from the frame 2211 and toward the stator 2216. If enough speed is underway by wheel 25, then the magnet will spin the frame 2211 forward. If not enough speed is underway, then the magnet 2215 will rock the frame 2211. Not shown is an optional hydraulic booster for the connecting rod 3008.

Figure 29:
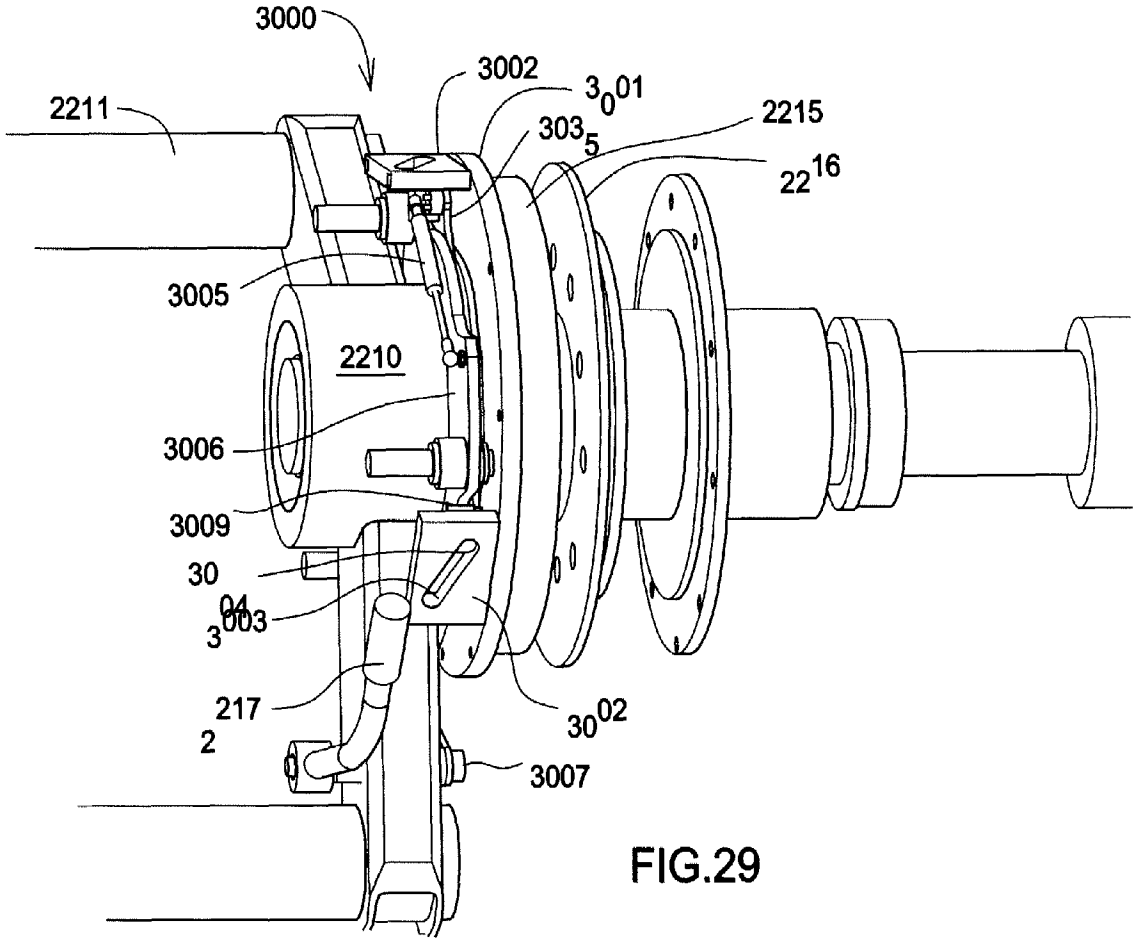
FIG. 29 is a front perspective view of the moving magnetic coupler assembly.
Figure 30:
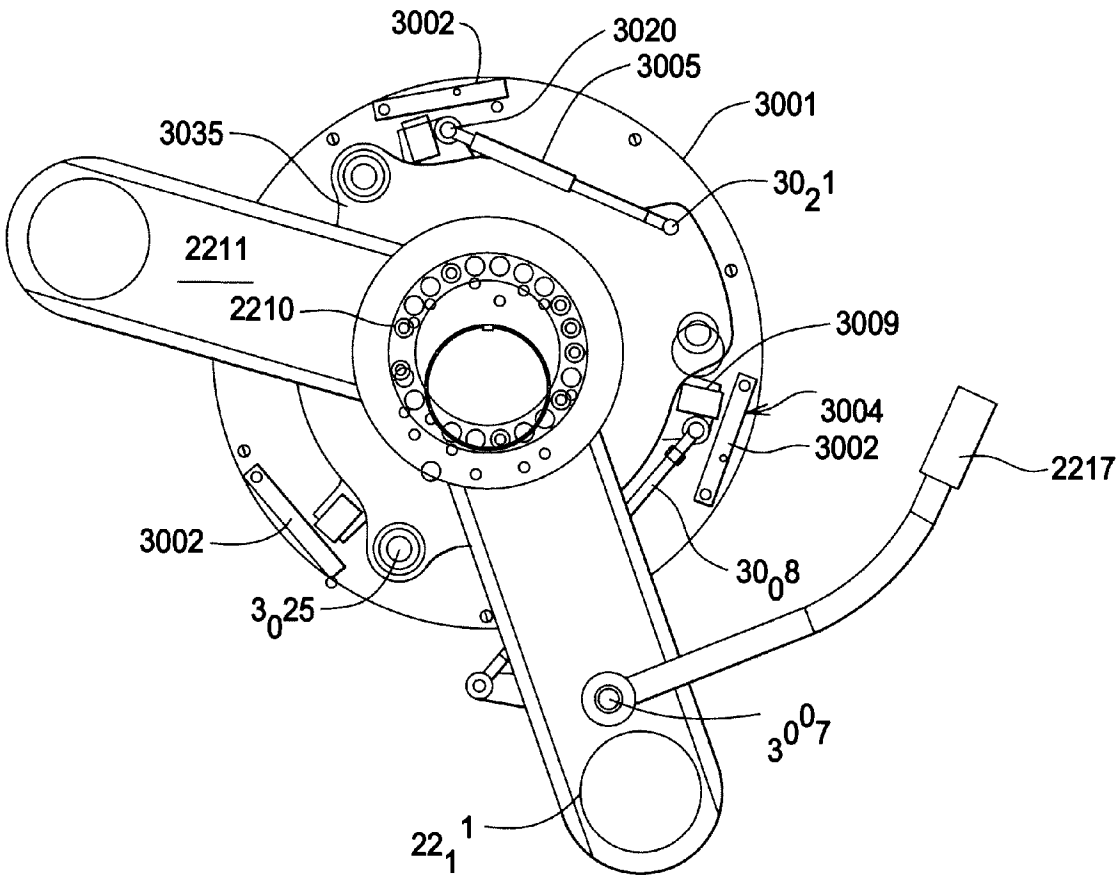
FIG. 30 is a side plan view of the moving magnetic coupler assembly.

When the joy stick 2217 is released the return gas spring 3005 back down to its disengaged position. FIG. 29 shows the thrust plate 3035 and magnet 2215 engaged for a spin.

Thrust plated pins 3025 slidably engage linear bearings 3026 to direct the thrust plate 3035 toward and away from stator 2216.

Figure 31:
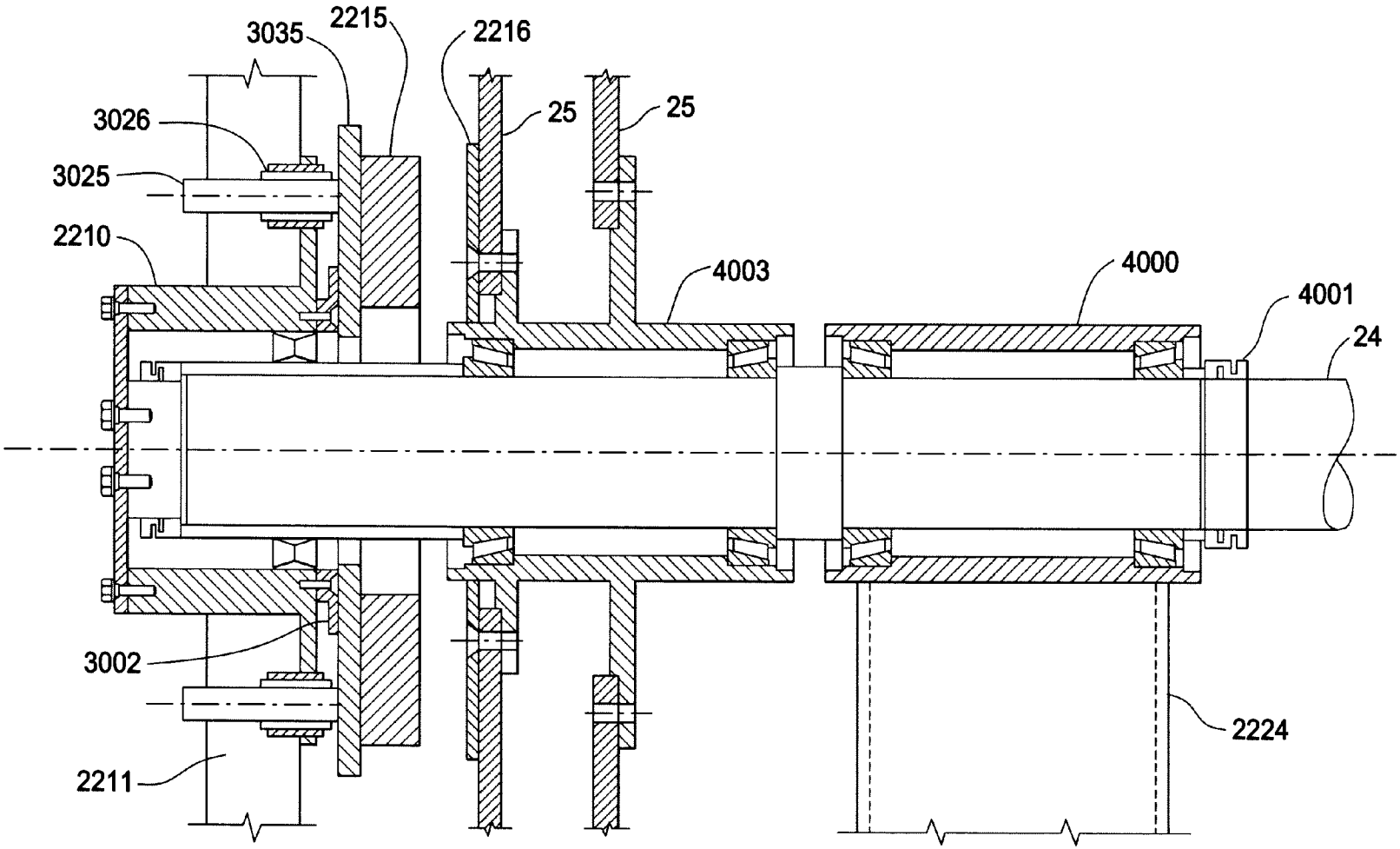
FIG. 31 is a cross sectional view of the moving magnetic coupler assembly.

FIG. 31 shows the past hub 4000 supporting axle 24. The adjustable lock nut 4001 secures the axle 24 to the post hub 4000. Wheel hub 4003 is the center of the wheel 25.

Figure 28:
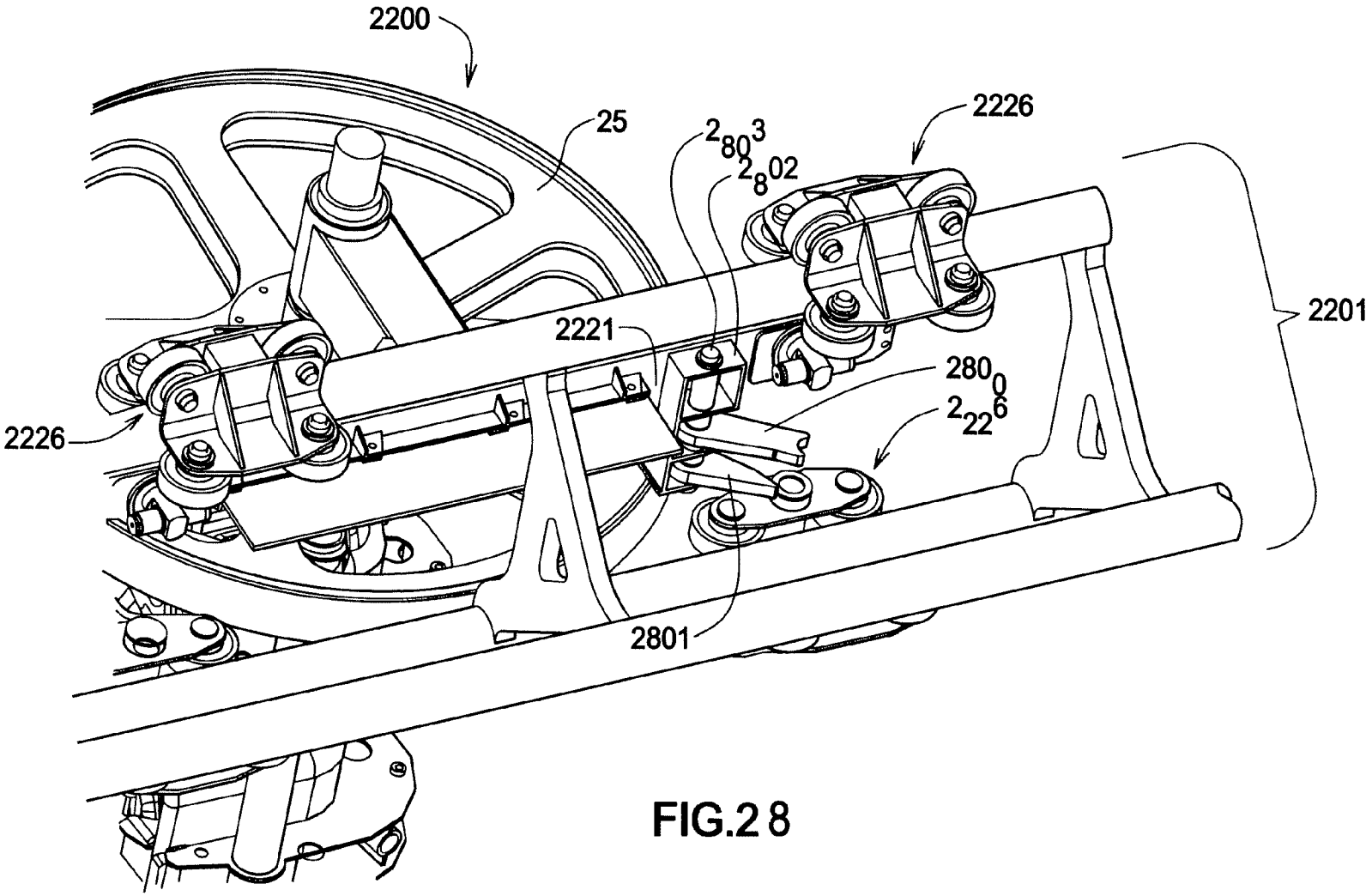
FIG. 28 is a bottom perspective view of the chain dog under the steerage assembly which is used to lift the conveyance up an incline.

Referring next to FIG. 28 a bracket 2802 is mounted to the longitudinal beam 2221. An axle 2803 supports a prior art anti-rollback dog 2800 and a chain dog 2801 which connect to a prior art chain 5 in a known manner to lift the conveyance 2200 up the first incline in a roller coaster layout as shown in FIG. 1.

Figure 32:
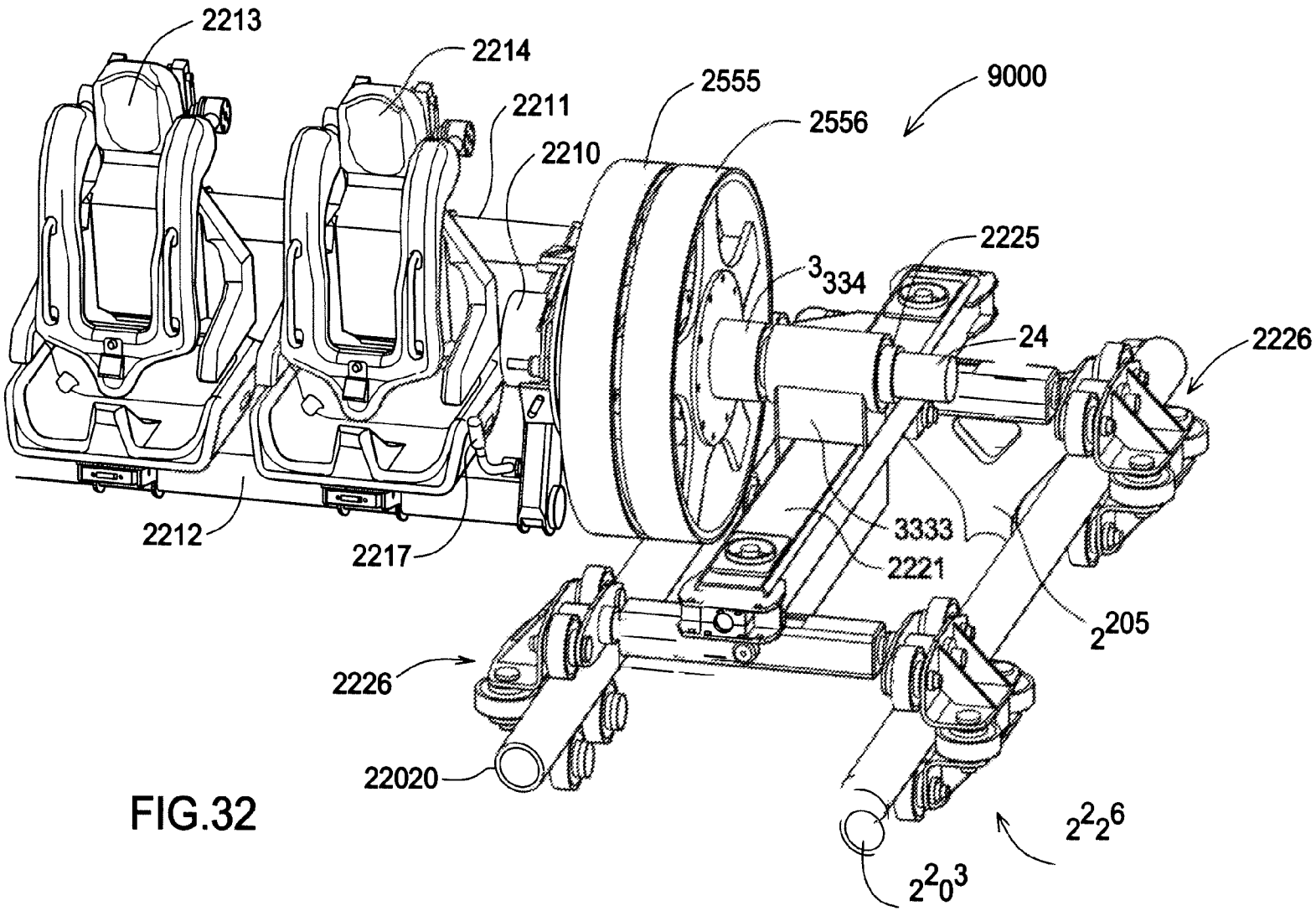
FIG. 32 is a front perspective view of a small, dual wheel embodiment conveyance.
Figure 33:
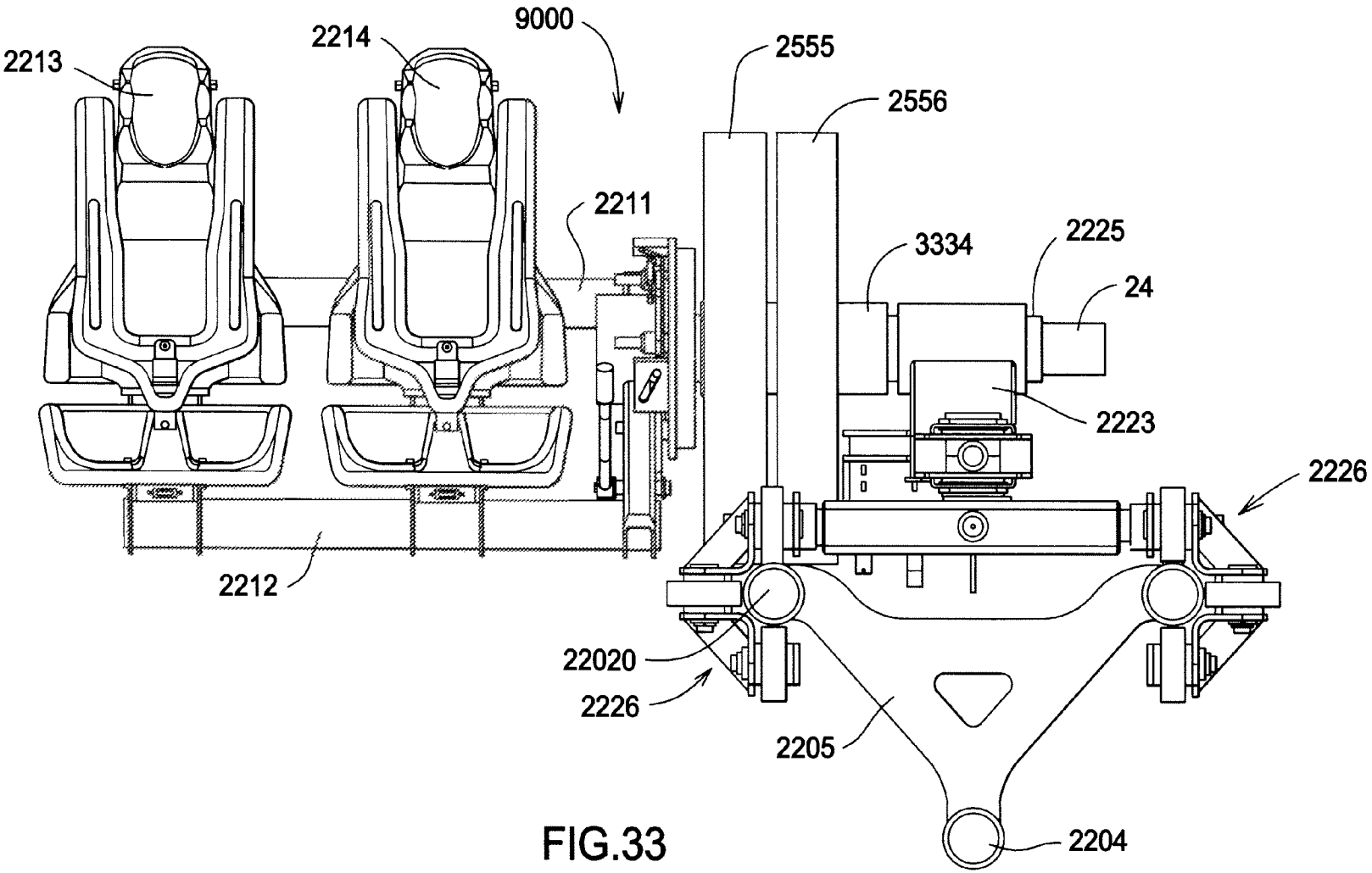
FIG. 33 is a front plan view of the small, dual wheel embodiment.
Figure 34:
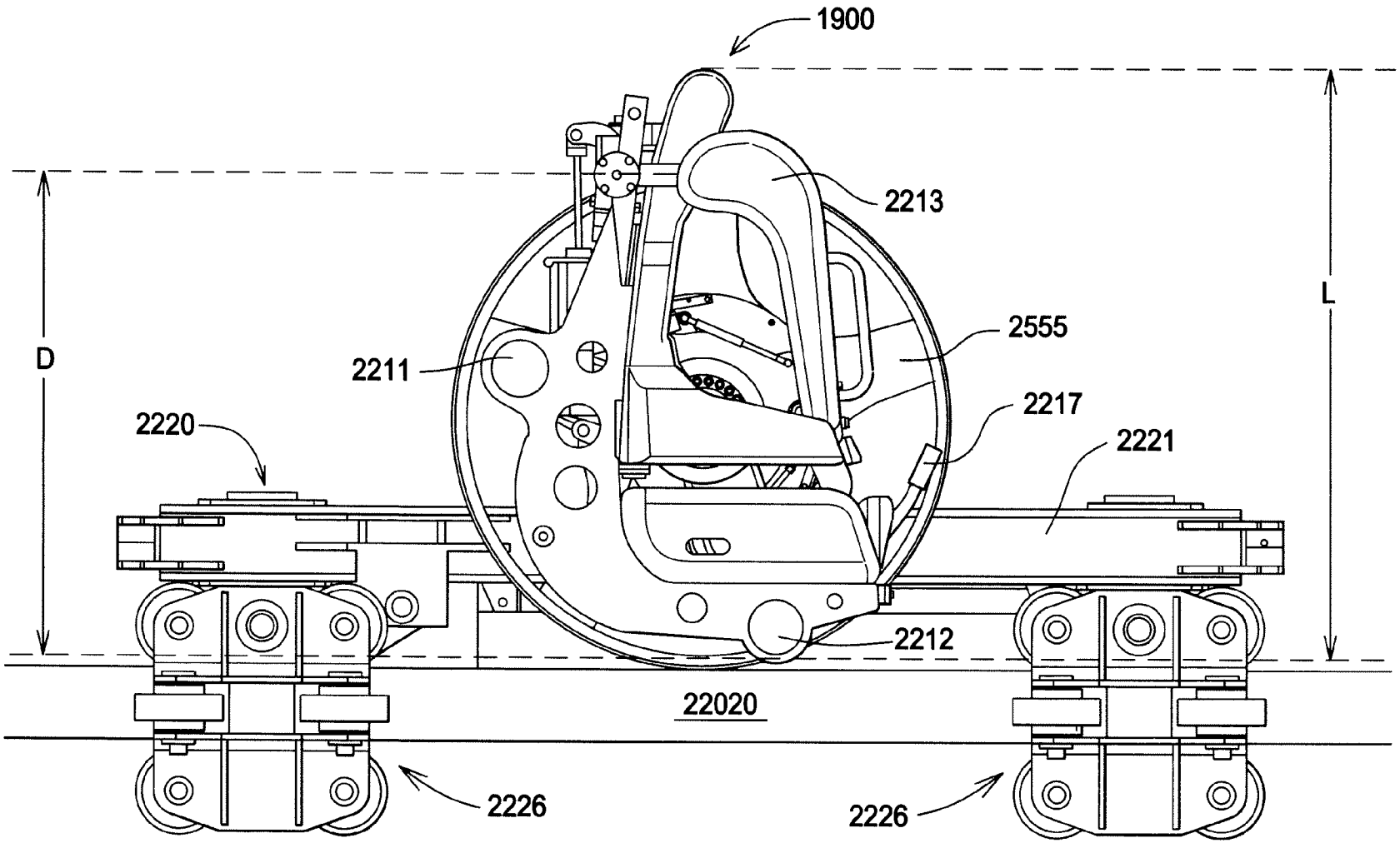
FIG. 34 is left side plan view of the small, dual wheel embodiment.

Referring next to FIGS. 32, 33, 34 a conveyance 9000 has one or more small wheels 2555, 2556 sharing a common axle 24. Small is defined as a diameter D equal to or less than the height L of the rider conveyance 1900. The wheel hub 3334 is part of second (optional) wheel 2556. Support post 3333 is sized to keep wheels 2555, 2556 about perpendicular to support track 22020. Support track 22020 is sized to support whatever wheel(s) width is chosen by the designer.

Central to the invention's concept is that any sized wheel or wheels support an axle 24 which in turn supports a rider frame 2211. Equivalent to an axle 24 support the frame 2211, a hub 3334 (on the other side of the wheel) could also support a rider frame 2211 in mid air as shown in FIG. 13. This free flight thrill to the rider is unique in a roundabout type ride.

In its broadest concept the unique conveyance could be rolled down a hill and/or pushed along a path. A ground version could use a counterweight and a pilot wheel attached to the opposite end of the axle as the rider frame.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A roller coaster ride comprising:

a conveyance rail assembly having a conveyance rail and a pilot rail;

a wheel rollable over the conveyance rail;

said wheel having a hub assembly supporting a rider frame on one side of the wheel and a steerage assembly on an opposite side of the wheel;

said rider frame supporting a rider support means functioning to hold a rider during a ride;

said steerage assembly having a connection to the pilot rail;

wherein the wheel is raised to a high point of the conveyance rail assembly and released to ride along the conveyance rail as guided by the pilot rail;

wherein the hub assembly further comprises an axle which provides the exclusive support for the rider frame and the steerage assembly;

wherein the axle is the axle of the wheel;

wherein the rider support means further comprises a seat which is suspended exclusively by the axle and has no support means beneath it;

wherein the steerage assembly further comprises a base with a connection to the hub assembly, said base having a plurality of roller wheels riding on the pilot rail; and wherein the wheel has a diameter of at least about five feet.

2. The apparatus of claim 1, wherein the hub assembly has a flip means functioning to selectively engage the wheel to the rider frame, thereby flipping the rider frame around the axle of the hub assembly.

3. The apparatus of claim 1, further comprising a group of wheels coupled together to form a train, wherein each steerage assembly has a coupler.

4. The apparatus of claim 2, wherein the flip means further comprises a magnet assembly interlocking the frame to the wheel, wherein a variable distance mechanism moves the frame toward and away from the wheel.

5. The apparatus of claim 4, wherein the magnet assembly further comprises a magnet mounted to the frame and stator mounted to the wheel.

6. The apparatus of claim 1, wherein the steerage assembly base connection further comprises a plurality of transverse arms, each arm having a roller assembly at each of its ends, and each roller assembly having a plurality of rollers.

7. The apparatus of claim 1, wherein the conveyance assembly further comprises a structural support rail and a bracket interconnecting the structural support rail to the conveyance rail and the pilot rail.

8. An amusement ride comprising:

a rail assembly comprising a conveyance rail mounted parallel to a pilot rail;

a large wheel rollable on the conveyance rail;

said large wheel having an axle supporting a rider frame on one side and a steerage assembly on an opposite side;

said axle being the exclusive support for the rider frame;

said steerage assembly having a connection to the pilot rail;

wherein the rider frame supports a holder for a rider;

wherein the steerage assembly further comprises a bracket from the axle to a base which has a plurality of wheels attached to the pilot rail;

wherein the rail assembly has a roller coaster layout with a hoist means functioning to raise the large wheel to a high point and release it to travel down the roller coaster layout; and the rider frame having a flip means connected to the axle functioning to selectively engage the rider frame to the large wheel, thereby flipping the rider frame around.

9. The apparatus of claim 8, further comprising a group of large wheels coupled together to form a train.

10. The apparatus of claim 8, wherein the rail assembly further comprises a structural rail and an interconnection among the structural rail, the conveyance rail and the pilot rail.

11. The apparatus of claim 8, wherein the base further comprises a transverse arm having a roller assembly at each of its ends, said plurality of wheels attached to the roller assemblies.

12. The apparatus of claim 8, wherein the flip means further comprises a rider operated controller that moves the frame a variable distance from the large wheel, the large wheel having a first member of a magnetic coupler, and the frame having a second member of the magnetic coupler.

13. The apparatus of claim 12, wherein the first member is a stator, and the second member is a magnet.

14. The apparatus of claim 12, wherein the first member of the magnetic coupler further comprises a thrust plate having a cam assembly to move the first member toward and away from the second member of the magnetic coupler, wherein a rider operated controller controls the cam assembly.

15. The apparatus of claim 14, wherein the cam assembly further comprises a cam plate affixed to the thrust plate, and the rider operated controller moves an actuator rod through a cam slot in the cam plate.

16. An amusement ride comprising:

a rail assembly means functioning to support a conveyance rail and a pilot rail running parallel to each other;

a large wheel means functioning to run along the conveyance rail and support a rider conveyance on one side thereof and a steerage assembly means on an opposite side thereof;

wherein the steerage assembly means functions to connect the wheel means to the pilot rail to provide guidance and balance for the wheel means;

wherein the large wheel means further comprises an axle which supports the rider conveyance and the steerage assembly means and which is the axle of the large wheel means;

said axle being the exclusive support for the rider conveyance;

wherein the steerage assembly means further comprises a connection from the axle to a base which has a roller connection to the pilot rail; and wherein the rail assembly means further comprises a roller coaster layout with a hoist means functioning to lift the large wheel means to a high point of the layout and release the wheel means to travel down the layout.

17. An amusement ride comprising:

a rail assembly means functioning to support a conveyance rail and a pilot rail running parallel to each other;

a wheel means functioning to run along the conveyance rail on one side thereof and a steerage assembly means on an opposite side thereof;

wherein the steerage assembly means functions to connect the wheel means to the pilot rail to provide guidance and balance for the wheel means;

wherein the wheel means further comprises an axle which supports the rider conveyance and the steerage assembly means and about which said wheel means rotates;

said axle being the exclusive support for the rider conveyance;

wherein the steerage assembly means further comprises a connection from the axle to a base which has a roller connection to the pilot rail; and wherein the wheel means further comprises a motive force means functioning to propel the wheel means along the rail assembly.

18. The apparatus of claim 17, wherein the rail assembly means has a relatively flat layout.

19. The apparatus of claim 17, wherein the wheel means has a diameter of at least about five feet.

20. A conveyance comprising:

a wheel having an axle;

said axle supporting a rider frame means functioning to support a rider thereon on a first end;

said axle being the exclusive support for the rider frame means;

a second end of the axle having a wheel support means on the opposite side of the wheel functioning to stabilize the wheel against the weight of the rider frame means;

wherein the wheel can travel along a path in an upright manner supporting the rider frame means outbound from the wheel;

wherein the path further comprises a support track; and the track mounted wheel support means further comprises a powered steerage assembly means functioning to propel the conveyance around the circular support track; and wherein the wheel is in contact with at least a portion of the path.

21. The conveyance of claim 20, wherein the wheel has a diameter less than or equal to a height of the rider frame means.

22. The conveyance of claim 21, wherein the wheel further comprises an adjoining wheel sharing the same axle.

23. The conveyance of claim 20, wherein the support track further comprises a roller coaster layout.

24. The conveyance of claim 23, wherein the rider frame means further comprises a spin means functioning to controllably spin the rider frame means around in relation to the axle by using a rotational force of the wheel.

25. The conveyance of claim 24, wherein the spin means further comprises a magnetic coupler between the wheel and the rider frame means.

* * * * *

UNITED STATES PATENT AND TRADEMARK OFFICE

CERTIFICATE OF CORRECTION

PATENT NO. : 7,594,473 B2
APPLICATION NO. : 11/419170
DATED : September 29, 2009
INVENTOR(S) : Kitchen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 313 days.

Signed and Sealed this

Fourteenth Day of December, 2010

David J. Kappos

David J. Kappos
*Director of the United States Patent and Trademark Office*